US006935261B2

(12) United States Patent
Rose'Meyer

(10) Patent No.: US 6,935,261 B2
(45) Date of Patent: Aug. 30, 2005

(54) APPARATUS FOR BODY MOTION STEERING CONTROL FOR WATER CRAFT

(76) Inventor: Maurice Rose'Meyer, RR #1, Baysville, Ontario (CA), P0B 1A0

( * ) Notice: Subject to any disclaimer, the term of this patent is extended or adjusted under 35 U.S.C. 154(b) by 0 days.

(21) Appl. No.: 10/751,487

(22) Filed: Jan. 6, 2004

(65) Prior Publication Data

US 2004/0139901 A1 Jul. 22, 2004

Related U.S. Application Data

(60) Provisional application No. 60/438,080, filed on Jan. 6, 2003.

(51) Int. Cl.[7] ..... B63H 20/08
(52) U.S. Cl. ..... 114/144 R; 440/63
(58) Field of Search ..... 114/144 R, 153, 114/363; 440/63

(56) References Cited

U.S. PATENT DOCUMENTS 1,133,788 A * 3/1915 Bassford ..... 440/32
1,634,257 A * 7/1927 Garro ..... 440/30
2,666,407 A * 1/1954 Wilkirson ..... 114/144 A
2,845,891 A * 8/1958 Frey ..... 114/144 A
2,989,021 A * 6/1961 Meloche ..... 440/53
3,010,421 A * 11/1961 Perkins ..... 440/28
3,211,125 A * 10/1965 Yarbrough ..... 440/28
4,645,462 A * 2/1987 Fulton ..... 440/6
4,891,024 A * 1/1990 Benjamin ..... 440/28
5,207,604 A * 5/1993 McMillin ..... 440/62

* cited by examiner

*Primary Examiner*—Andrew D. Wright
(74) *Attorney, Agent, or Firm*—Gordon Thomson

(57) ABSTRACT

An apparatus for steering control of water craft by operator body motion commands. The craft is powered by an outboard motor having a first vertical axis. The water craft has a swivel seat co-axially mounted to first and second swivel bodies permitting rotation of the seat about a second vertical axis. There is a first control member-mounted between the seat and the first swivel body and a second control member mounted between the first and second swivel bodies. A connecting member connects the second control member to the outboard motor so that when a pin couples the first and second control members together the apparatus is engaged and swivel seat is able to transmit body motion steering commands via the connecting member to the outboard motor.

18 Claims, 22 Drawing Sheets

APPARATUS FOR BODY MOTION STEERING CONTROL FOR WATER CRAFT

CROSS-REFERENCE TO RELATED APPLICATIONS

This non-provisional patent application claims the benefit of U.S. Provisional Patent Application 60/438,080 filed on Jan. 6, 2003.

BACKGROUND OF THE INVENTION

1. Field of the Invention

This invention relates to water craft. This invention further relates to an apparatus for steering control of water craft by operator body motion commands.

2. Background of the Invention

Water craft with outboard motors are commonly used for recreational fishing in rivers and lakes. The outboard motors are electric or gasoline driven. One type of fishing, called trolling, requires the operation of the outboard motor while fishing. When trolling, the operator is compelled to steer the craft while fishing. Understandably, the operator, holding the fishing rod, will find it difficult to steer the craft and fish at the same time. Prior to my invention, trolling usually required setting the motor in a first desired direction along a first desired track. When the operator desires to change to a second direction and track, it is necessary to suspend fishing operations and direct fill attention to the outboard motor. Clearly, this disruption of fishing operations leads to a lessened enjoyment of the sport.

Therefore, it is desirable to have an apparatus that can be used for trolling that does not require the disruption of fishing operations to steer the craft.

OBJECTIVES OF THE INVENTION

It is an object of the present invention to provide an apparatus for steering control of a water craft by operator body motion commands.

It is a further objective of the present invention to provide an apparatus for steering water craft that does not require the operator to suspend fishing operations in order to change the direction of the water craft.

SUMMARY OF THE INVENTION

My invention is an apparatus for steering control of a water craft by operator body motion commands. The water craft has at least one flat hull cross-member having an upper surface and is propelled by an outboard motor having a first vertical axis. The apparatus comprises a swivel seat for accepting said body steering commands. The seat comprises swivel means for rotation about a second vertical axis and a bottom surface. The swivel seat has a first disengaged mode wherein the body motion commands are not transmitted to the outboard motor; and, a second engaged mode wherein the body motion commands are transmitted to the outboard motor. Also included are means for moving the swivel seat from the first disengaged mode to the second engaged mode and back again to the first disengaged mode. The invention includes means for transmitting the body motion commands to the outboard motor, whereby the body motion commands are translated into steering commands causing the outboard motor to pivot in a desired direction about the first vertical axis.

Swivel means comprises a first swivel co-axial with the second vertical axis and mounted by mounting means to the at least one flat hull cross-member upper surface; and, a second swivel coaxial with the second vertical axis and mounted by mounting means between the first swivel and the bottom surface of the swivel seat.

Engagement means comprises a first control member having a first end and a second end. The first control member first end is mounted by mounting means between the first swivel and the swivel seat bottom surface. There is a slotted sleeve fixed to the first control member second end. There is also a second control member having a first end and a second end. The second control member first end is mounted by mounting means between the first swivel and the second swivel. The second control member second end has an aperture and this aperture is co-axial with the slotted sleeve. A retractable biased engagement pin is slidably mounted within the slotted sleeve. The pin has an engagement end. The pin further has a first retracted position wherein the engagement end of the pin is disengaged from the aperture. This results in the swivel seat being in its first disengaged mode. In the second engaged position, the pin engagement end is engaged with the aperture thereby coupling the first control member to the second control member. This results in the first and second control members rotating dependently so that rotation of the swivel seat about the second vertical axis causes identical rotation of the second control member about the second vertical axis.

Means for transmitting the body motion commands to the outboard motor comprise a connecting member having a first end and a second end. The first end is connected by first connecting means to the second control member. The second end is connected by second connecting means to the outboard motor so that movement of the second control member about the second vertical axis is transmitted by the connecting member to the outboard motor and translated into sympathetic movement of the outboard motor about the first vertical axis.

The first swivel comprises a first upper mounting plate, a first lower mounting plate mounted to the hull cross-member upper surface; and, a first circular bearing track disposed between the first lower mounting plates and the first upper mounting plate. The first circular bearing track includes a first plurality of bearings permitting rotation of the first lower mounting plate with respect to the first upper mounting plate. The second swivel is similarly constructed.

Construction of the swivel seat comprises a horizontal seating platform having a left side and a right side. The horizontal seating platform is contoured for receiving the buttocks of an operator. There is also an upward sloping left side member fixed to the left side of the horizontal seating platform. The left side member is adjacent to the left thigh of an operator and contoured to receive the contour of the left thigh of an operator. There is also an upward sloping right side member fixed to the right side of the horizontal seating platform and positioned adjacent to the right thigh of an operator. It is contoured to receive the contour of the right thigh of an operator. The seat includes a backrest fixed to the horizontal seating platform. The backrest is adapted for pivoting adjustment about a horizontal axis for operator comfort.

The first control member comprises a first plate having a longitudinal axis. This first plate has a paddle shape comprising four contiguous and congruent portions: a shaft portion, a throat portion, a blade portion and tip portion. The shaft portion has a first end having a first width, a first side and a second side. The first side and the second side are parallel and the first end is disposed perpendicular between the first side and the second side. The throat portion has a third side and a fourth side that are incurvate. The blade portion has a fifth side and a sixth side that are arcuate. The tip portion is linear and disposed between the fifth side and the sixth side, perpendicular to the longitudinal axis and parallel to the first end. The shaft portion includes an aperture located adjacent to the first end and upon the longitudinal axis. The blade portion includes a first elongate aperture having a first aperture longitudinal axis having an angle of about negative 45 degrees from the first control member longitudinal axis. There is a second elongate aperture having a second aperture longitudinal axis having an angle of about positive 45 degrees from the first control member longitudinal axis. The blade portion is mounted between the bottom surface of the swivel seat and the second rectangular upper mounting plate.

The second control member comprises a second flat plate having a second flat plate longitudinal axis, a top surface and a bottom surface. The second flat plate has a substantially keystone shape including a flat bottom side, a lower left corner, a lower right corner, an arcuate top side, a top left corner, a top right corner, a left side inclined away from the second flat plate horizontal axis, and a right side inclined away from the second flat plate horizontal axis. The second control member further includes: a first elongate aperture located proximate to the lower left corner; a second elongate aperture located proximate to the lower right corner; a third aperture located proximate to the left side with a raised collar; a fourth aperture located adjacent to the third aperture and proximate to the left side also having a raised collar; a fifth elongate aperture located proximate to the top left corner; a sixth elongate aperture located proximate to the top right corner; and, a seventh aperture located at the top end of the longitudinal axis of the second control member. The second control member further includes: a first rectangular projection projecting from the top left corner; a second rectangular projection projecting from the middle of the arcuate top surface along the longitudinal axis; and, a third rectangular projection projecting from the top right corner. These are adapted as sighting guides so that an operator can visually guide the pin into engagement with the second control member. The second control member is mounted between the first rectangular upper mounting plate and the second rectangular lower mounting member.

Means for transmitting body use motion commands from the seat body to the outboard motor comprise: a connecting member having a first threaded end and a second threaded end; means for connecting the connecting member first threaded end to the second control member; and, means for connecting the connecting member second threaded end to the outboard motor. Connecting means comprise a bracket comprising: a base having a threaded aperture adapted to receive the connecting member first threaded end; a first tine fixed to the base having a first arcuate free end in which there is a first tine first aperture. There is also a second tine fixed to the base opposite to and parallel to the first tine. The second tine has a second arcuate free end also with an aperture. The bracket is adapted to receive the left side of the control member between the first and second tines. The first tine first aperture and the second tine second aperture are co-axially aligned with the control plate third aperture. There is also included a second pin member adapted for releasable engagement within the co-axially aligned first tine first aperture, second tine second aperture and second control member third aperture thereby fixing the connecting member first end to the second control member in a pivoting relationship.

Means for connecting the connecting member second end to the outboard motor comprises a bracket similar to the one described above. In addition, there is a bracket arm having a longitudinal axis, a first half and a second half. The first half has at least two apertures positioned vertically and the second half also has at least two apertures positioned vertically. There is one threaded longitudinal bore in the bracket arm adapted to receive a threaded rod. A friction clamp is clamped around the vertical shaft casing of the outboard motor. It has a collar portion adapted to frictionally engage the vertical shaft casing and two adjacent and parallel arms apertured to receive the threaded rod. To tighten the friction clamp, there is a throttling nut adapted for threaded engagement onto the threaded rod. A pin is used for pinning the bracket first end between the third tine and the fourth tine in a pivoting relationship.

Further objects and advantages will become apparent from a consideration of the ensuing description and drawings.

DETAILED DESCRIPTION OF THE PREFERRED EMBODIMENT

Figure 1:
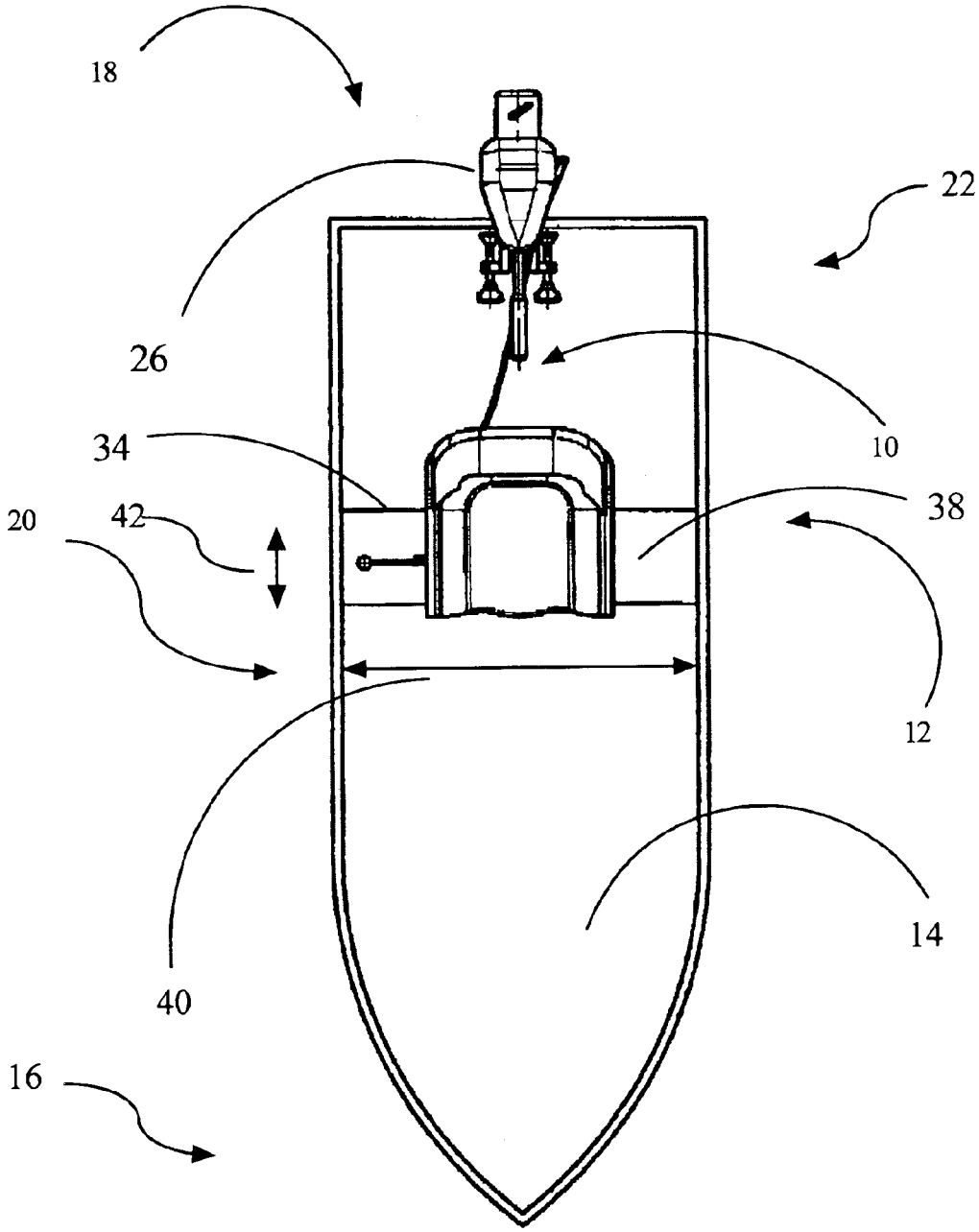
FIG. 1 illustrates a top view of an open water craft having an outboard motor and centered swivel seat and elements of my invention.
Figure 2:
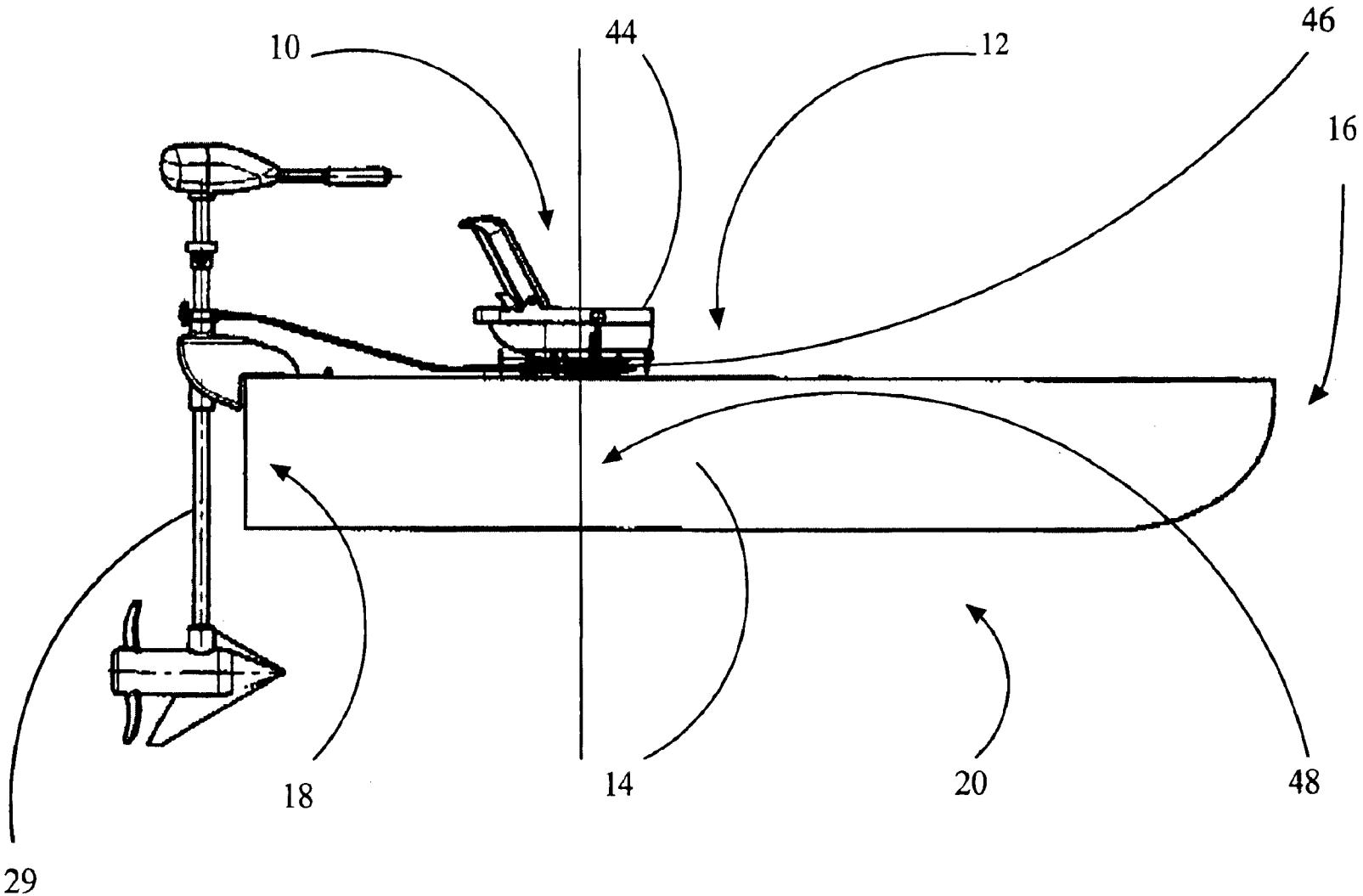
FIG. 2 illustrates a side view of an open water craft having an outboard motor and a centered swivel seat and shows the connecting member of my invention between the seat and the outboard motor and the general location of the first and second swivels of my invention situated below the seat.
Figure 3:
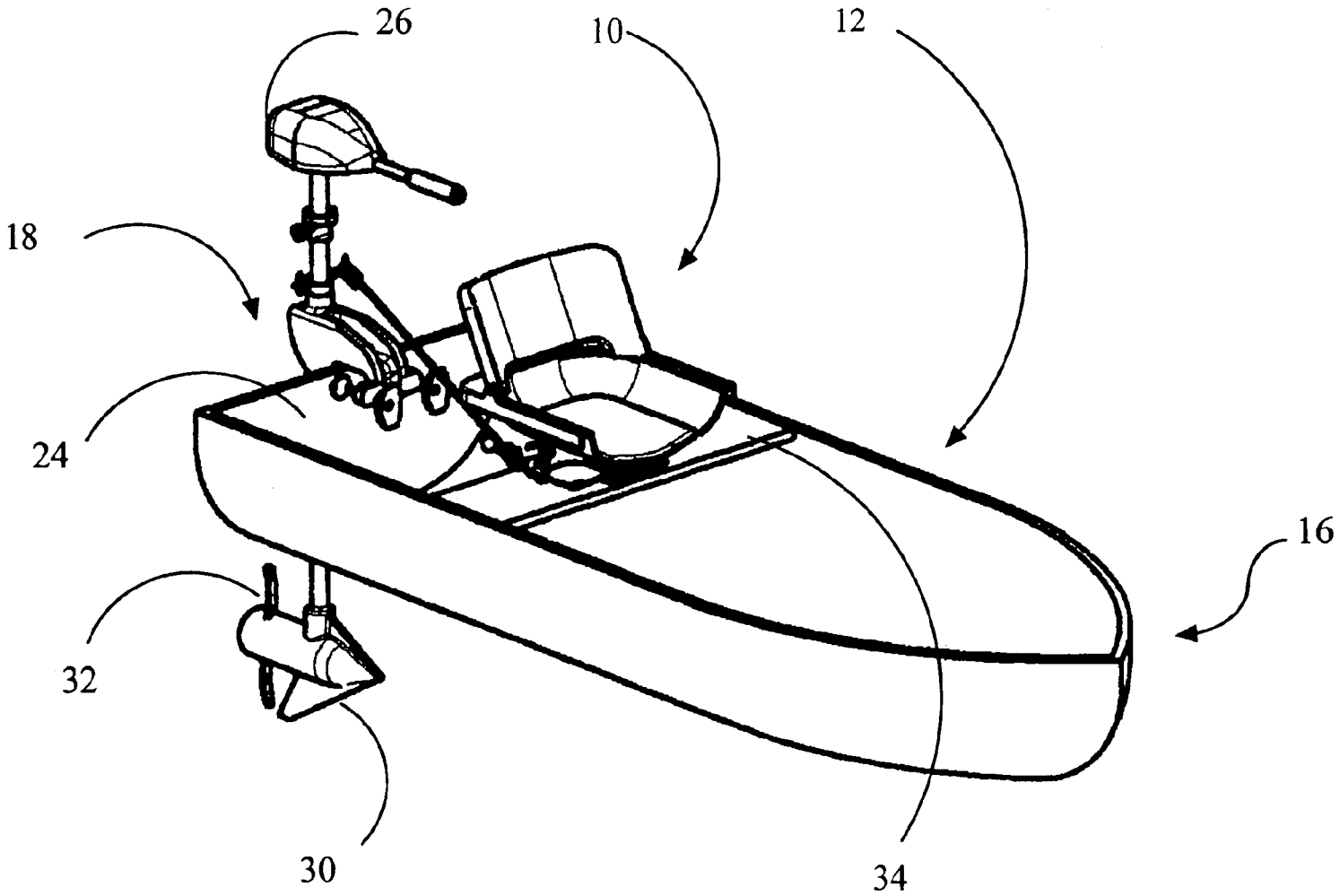
FIG. 3 is a perspective view of an open water craft having an outboard motor and a centered swivel seat showing elements of my invention.
Figure 4:
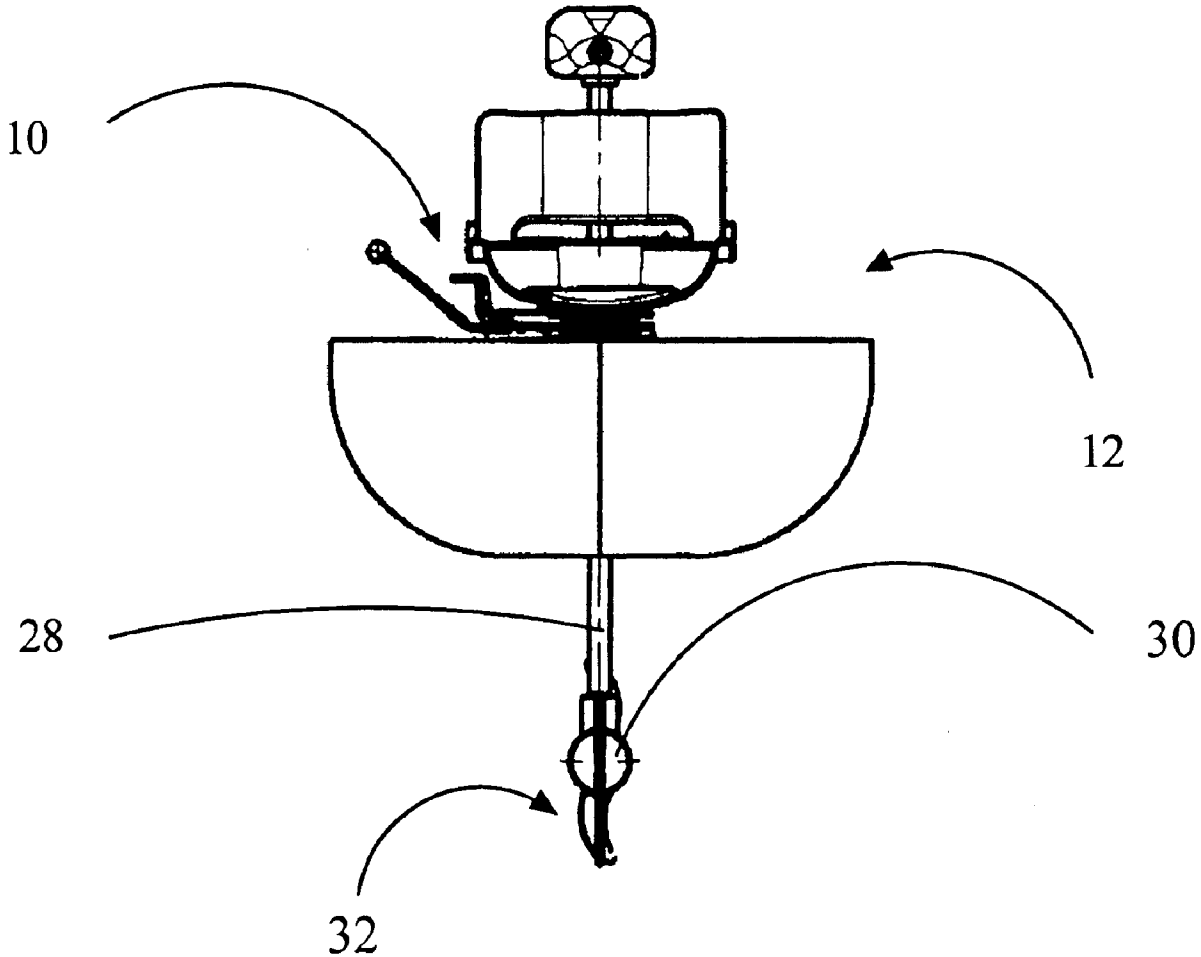
FIG. 4 is a front view of an open water craft having an outboard motor and centered swivel seat showing elements of my invention.
Figure 5:
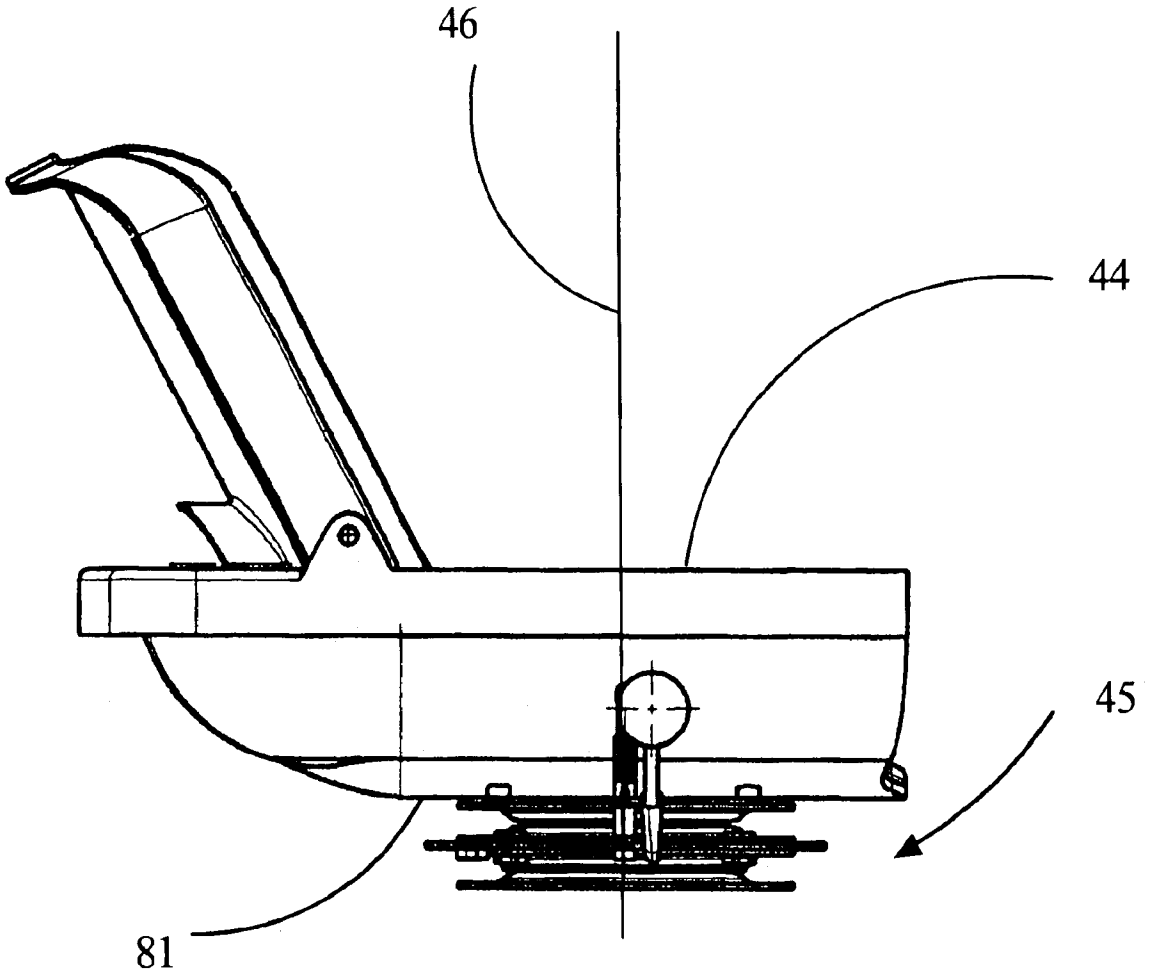
FIG. 5 is a side view of a swivel seat of the type shown in FIGS. 1, 2, and 3 showing elements of my invention.
Figure 6:
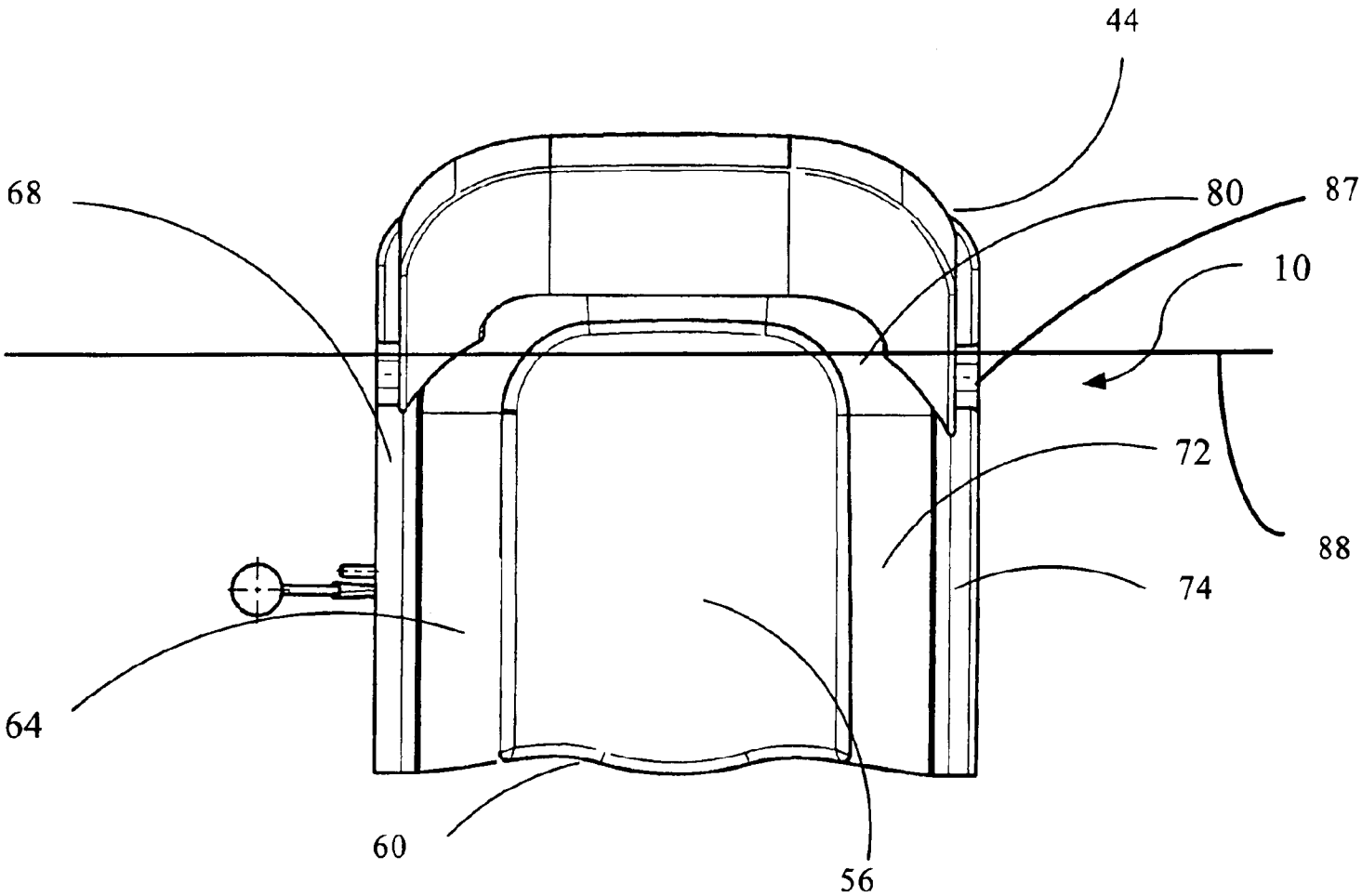
FIG. 6 is a top view of the seat shown in FIG. 5.
Figure 7:
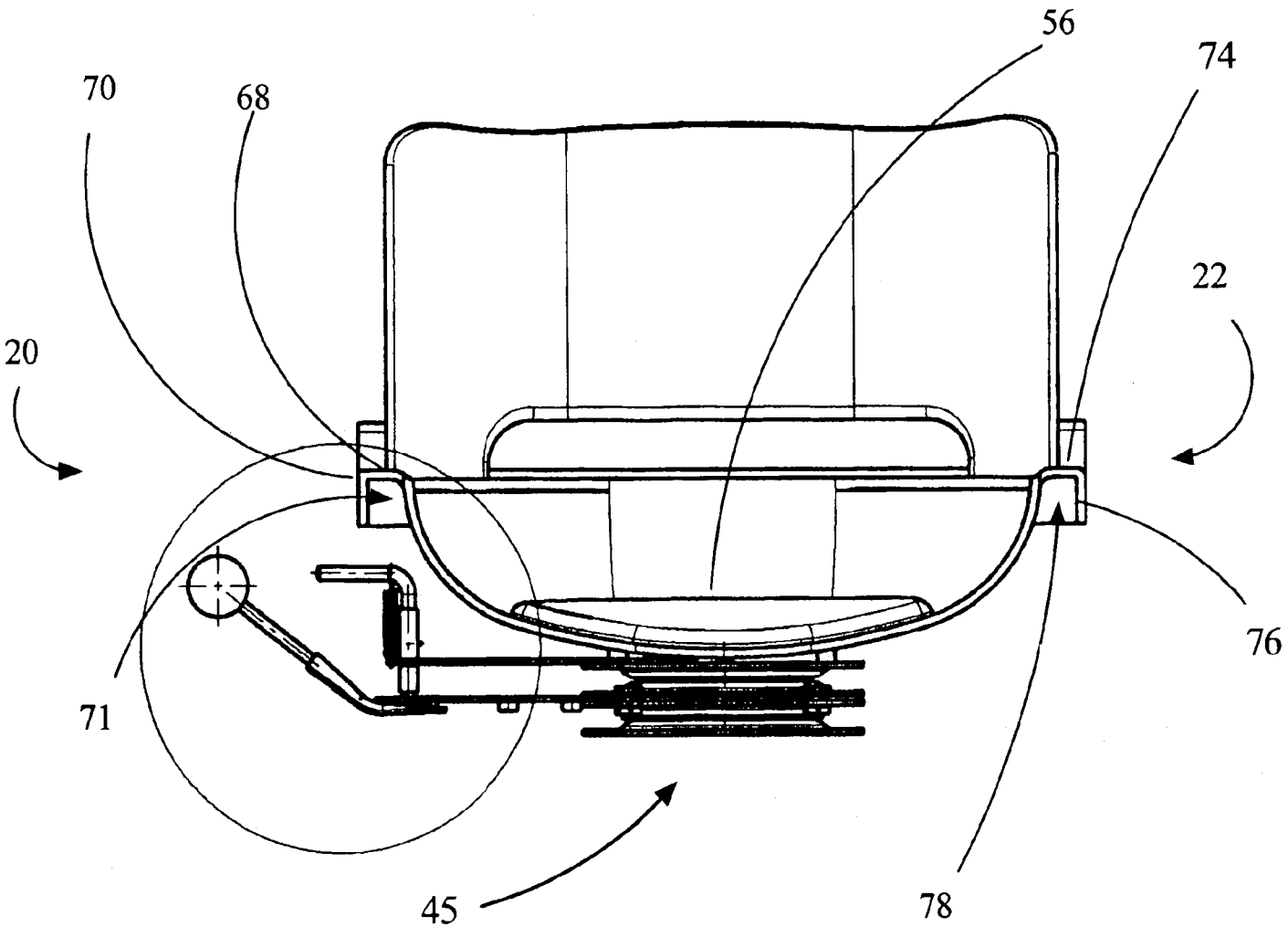
FIG. 7 is a front view of the seat shown in FIGS. 5 and 6 showing elements of my invention.
Figure 8:
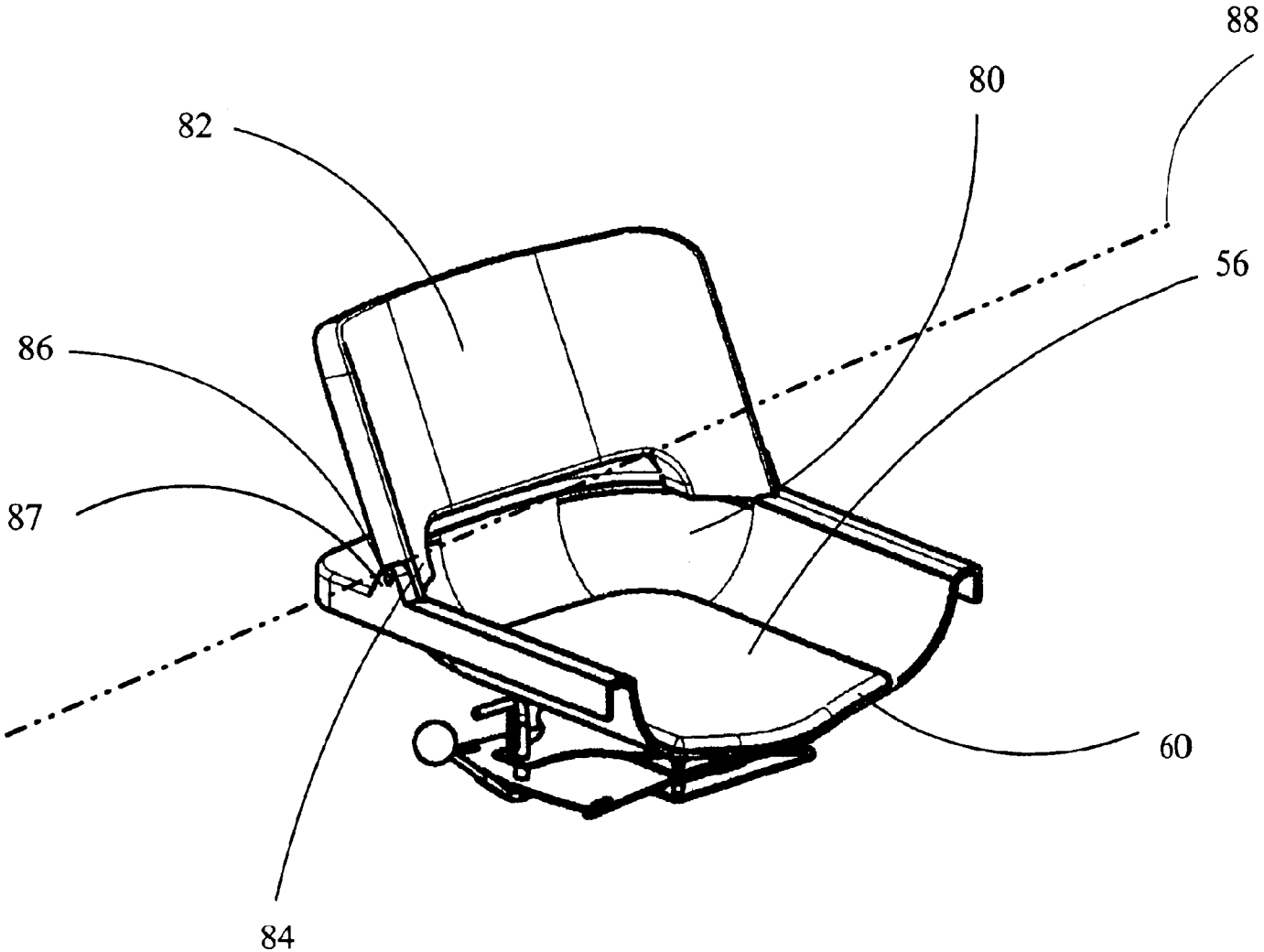
FIG. 8 is a perspective view of the seat shown in FIGS. 5, 6 and 7 showing elements of my invention.

Referring to FIGS. 1, 2, 3 and 4 my invention shown generally as (10) is an apparatus for steering control of small water craft by operator body motion commands. My invention (10) is adapted for installation in a small water craft (12) having a hull (14), a bow (16), a stem (18), a left side (20) and a right side (22). The stern includes a transom member (24) adapted to mount an outboard motor (26). The outboard motor can be an electric trolling motor or a small gasoline driven motor. The motor has a vertical shaft casing (28) in which the drive shaft of the motor is contained. The shaft casing rotates about a first vertical axis (29). The drive shaft is connected by a transmission (30) to a propeller (32). The small craft includes at least one flat hull cross-member (34) acting as a seat. The at least one flat hull cross-member (34) has an upper surface (38), a first length (40) and a first width (42).

Referring now to FIGS. 5 to 8, the apparatus of my invention (10) comprises a swivel seat (44) having swivel means (45) permitting rotation of the seat (44) about a second vertical axis (46). The swivel seat (44) has a bottom surface (81). Swivel means (45) is mounted by mounting means to the upper surface of flat hull cross-member (34). Throughout the detailed description of my invention "mounting means" typically comprise a nut, bolt and washer combination. In another embodiment of the invention, the hull cross-member may be a separate rectangular member which can be temporarily and releasably fixed to the hull cross-member (34) by temporary mounting means such as clamps. The seat (44) is adapted to receive body motion commands from an operator as more fully explained below.

The apparatus of my invention has a first disengaged mode wherein the body motion commands of the operator are not transmitted to the outboard motor. The apparatus of my invention also has a second engaged mode wherein the body motion commands of the operator are transmitted to the outboard motor. Engagement means are included for moving the apparatus from the first disengaged position to the second engaged position. Means are provided for transmitting body motion commands of the operator to the outboard motor which cause the outboard motor to pivot in the desired direction about the first vertical axis.

Still referring to FIGS. 5 to 8, there is provided a more detailed description of the swivel seat (44) of my invention (10). The swivel seat (44) comprises a generally horizontal seating platform (56) having a left side and a right side. The seating platform may be contoured to more comfortably accept the buttocks of an operator. Alternatively, there may be a cushion fixed to the horizontal seating platform (56) for operator comfort. The seating platform (56) has a leading edge (60) having a sinusoidal contour that is adapted to comfortable accept the back thighs of an operator and, as well, to facilitate the swivel motion of the swivel seat by providing an abutting surface (at 60) between the legs of the operator for left and right swivel motions of the swivel seat.

In order to translate body motion of the operator into swivel motion of the swivel seat (44), the swivel seat includes a first upward curving left side member (64) fixed to the left side of the horizontal seating platform (56). The first curving left side member (64) has an inwards concave surface to better fit against the substantially convex contour of the left thigh of an operator. The first curving left side member (64) has a first top surface (68) to act as an arm rest and a first skirt (70) depending down from the first arm rest (68). The first skirt (70) and first top surface (68) create a first hollow (71) that may be used for grasping by the operator. Similarly, on the right side (22) of the swivel seat (44) there is a second upward curving right side member (72) fixed to the right side of the horizontal seating platform (56). The second curving right side member (72) has an inwards concave surface to better fit against the substantially convex contour of the right thigh of an operator. The second curving right side member (72) has a second top surface (74) adapted to act as an arm rest and a second skirt (76) depending from the second top surface (74). The second top surface (74) and the second skirt (76) act together to form second hollow (78) that may be used for grasping by an operator. The swivel seat (44) further includes a third upward curving back member (80) disposed between the left upwardly curving side member (64) and the right upward curving side member (72). The upward curving back member (80) is adapted to conform to the lower back and buttocks of an operator. The horizontal platform (56), left side member (64), right side member (72) and back member (80) are moulded from a suitable thermoplastic material from a single mould and form a single piece. Also included as part of the seating body (44) is back rest (82). Back rest (82) is moulded as a single piece from suitable thermoplastic materials and possesses a contour adapted to follow the contour of an operator's back for comfort and to facilitate transmission of body motions to the swivel seat (44). The bottom of back rest (82) includes a left projection (84) having an aperture (86) that is adapted to receive a pin in order to pin the left projection (84) to apertured lug (87) on the upper left surface (68). The right side is obviously similarly configured but not illustrated in this FIG. 8. This permits the backrest (82) to pivot to and fro around a horizontal axis (88).

Figure 9:
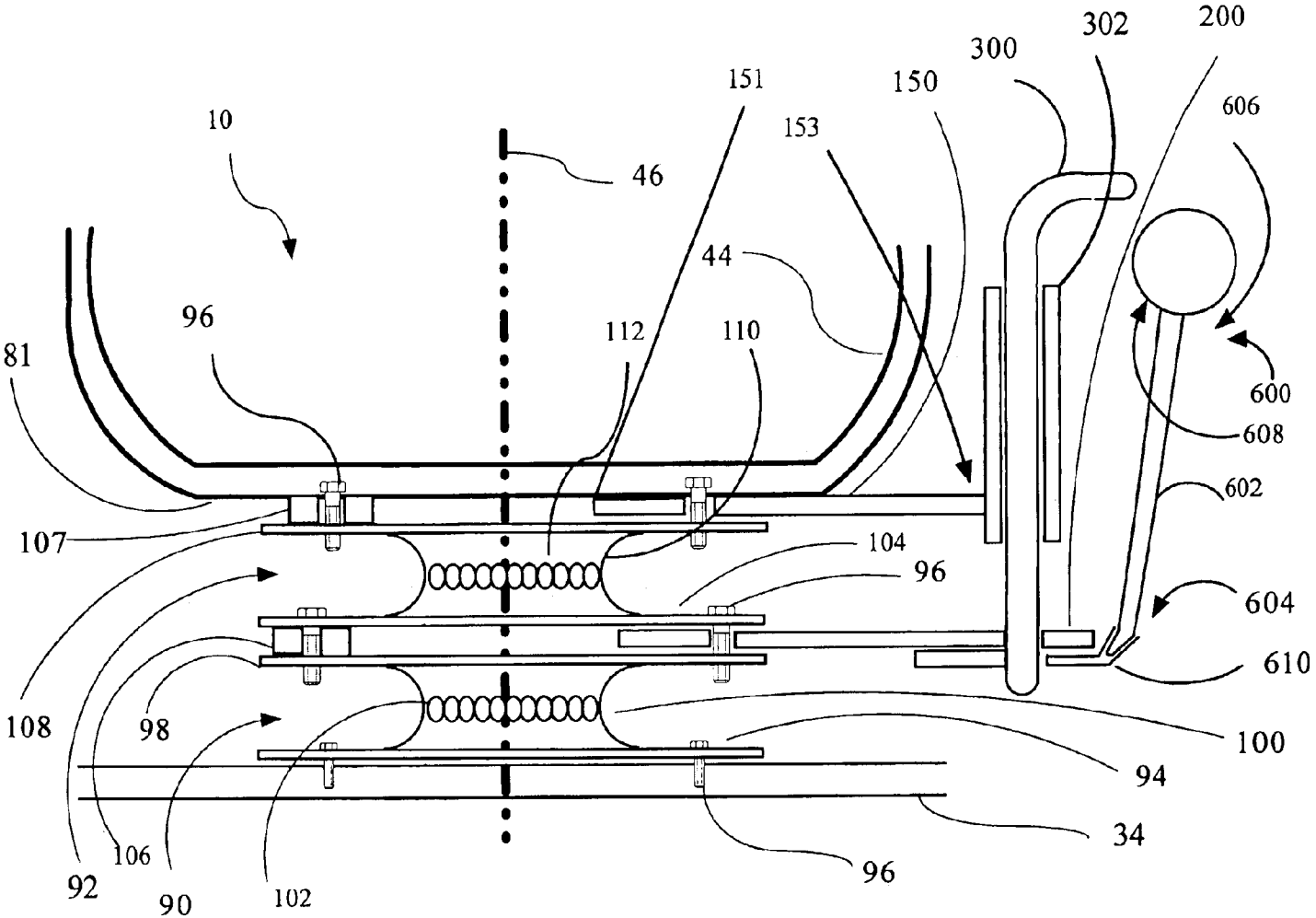
FIG. 9 is a detailed view of the swivels of one embodiment of my invention showing the pin engaged.

Referring now to FIG. 9, there is shown greater detail of the swivel means of my invention. Swivel means comprises a first swivel (90) co-axial with the second vertical axis (46) and a second swivel (92) also co-axial with the second vertical axis (46). The first swivel co-axial with the second vertical axis is mounted by mounting means (96) to the at least one flat hull cross-member (34) upper surface. The second swivel co-axial with the second vertical axis is mounted by mounting means (96) between the first swivel and the bottom surface (81) of the swivel scat.

Still referring to FIG. 9, the engagement means moving the apparatus from a disengaged mode to an engaged mode comprises a first control member (150) having a first end (151) and a second end (153). The first control member first end is mounted by mounting means between the first swivel and the swivel seat bottom surface. A slotted sleeve (302) is fixed to the first control member second end. There is also a second control member (200) having a first end (201) and a second end (203). The second control member first end is mounted by mounting means between the first swivel and the second swivel. The second control member second end has a series of apertures (242, 244 and 246) that move with the second control member to be co-axial with the slotted sleeve. In this FIG. 9, aperture (244) is under the sleeve.

Figure 10:
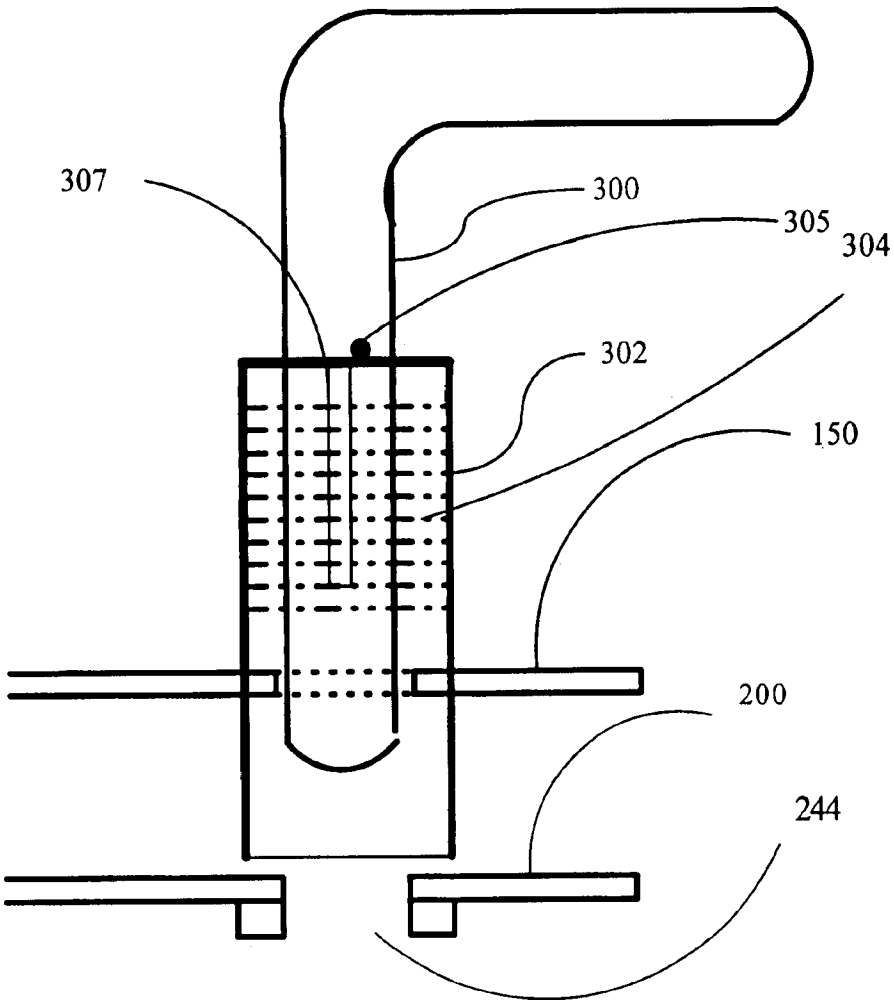
FIG. 10 is a detailed view of the pin disengaged of one embodiment of my invention.
Figure 11:
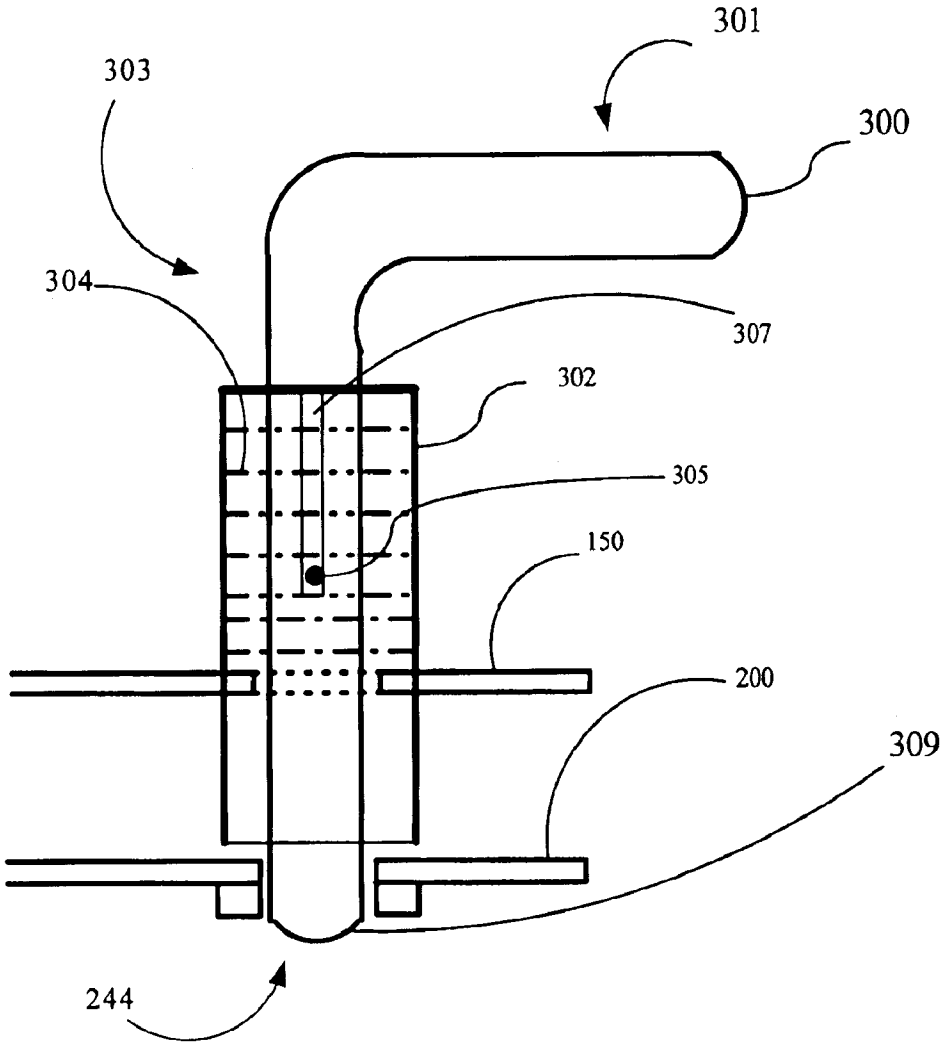
FIG. 11 is the same view as FIG. 10 showing the pin in the engaged position.

There is also a retractable biased engagement pin (300) slidably mounted within the slotted sleeve. As shown in FIG. 10, the pin has an engagement end (309). When the pin is in a first retracted position the pin engagement end is disengaged from the aperture resulting in the apparatus of my invention being in its first disengaged mode. As shown in FIGS. 9 and 11, when the engagement end of the pin is engaged with the aperture of the second control member the result is the coupling of the first control member to the second control member resulting in the apparatus of my invention being in its second engaged position. The first swivel (90) is free to rotate but the second swivel (92) is not free to rotate. The first and second control members rotate dependently and rotation of the swivel seat about the second vertical axis causes identical rotation of the second control member about the second vertical axis.

The first swivel (90) comprises a first lower mounting plate (94) mounted by mounting means (96) to the upper surface of the hull cross-member (34). The first swivel (90) also includes a first upper mounting plate (98) and a first circular bearing track (100) disposed between the first lower mounting plate and the first upper mounting plate including a plurality of bearings (102) disposed in the first bearing track. The bearings permit the first upper mounting plate (98) to rotate with respect to the first lower mounting plate (94) fixed to the upper surface of the hull cross-member (34).

The second swivel (92) comprises a second lower mounting plate (104) mounted by mounting means (96) in a spaced relationship above the first upper mounting plate (98) of the first swivel (90). Between mounting plate (104) and mounting plate (98) are shims (106) having a height equal to the height of the second control member (200).

There is also a second upper mounting plate (108) mounted by mounting means (96) in a spaced relationship to the bottom surface (81) of the swivel seat (44). There are shims (107) mounted between plate (108) and surface (81). The shims have the same height as the first control member (150).

The second swivel (92) also includes a second circular bearing track (110) disposed between the second lower mounting plate and the second upper mounting plate including a plurality of bearings (112) disposed in the second bearing track. The plurality of bearings permits the second lower mounting plate (104) to rotate with respect to the second upper mounting plate (98).

The four mounting plates (94), (98), (104) and (108) are apertured to accommodate mounting means (96).

Referring now to FIGS. 10 and 11 there is shown additional detail of pin member (300) disengaged from second control member (200). Pin member (300) is mounted in a sliding relationship within a sleeve (302) fixed to the end of first control member (150). Pin member (300) includes a shaft portion (303), a handle portion (301) and an engagement end (309). Spring (304) is included within the sleeve (302) to provide biasing to the pin member (300). Lugs (305) are fixed to opposite sides of pin member (300) and are adapted to slide up and out of slot (307) in sleeve (302) and rest upon the surface of sleeve (302) to keep pin (300) in a recessed position with spring (304) compressed within the sleeve.

Referring now to FIG. 11, pin member (300) is shown in engaged with control member (200) by engagement end (309). Spring (304) is in an expanded position and ensures that pin member (300) remains engaged until the operator lifts the pin out of sleeve (302). The lugs (305) and are within slot (307).

Figure 12:
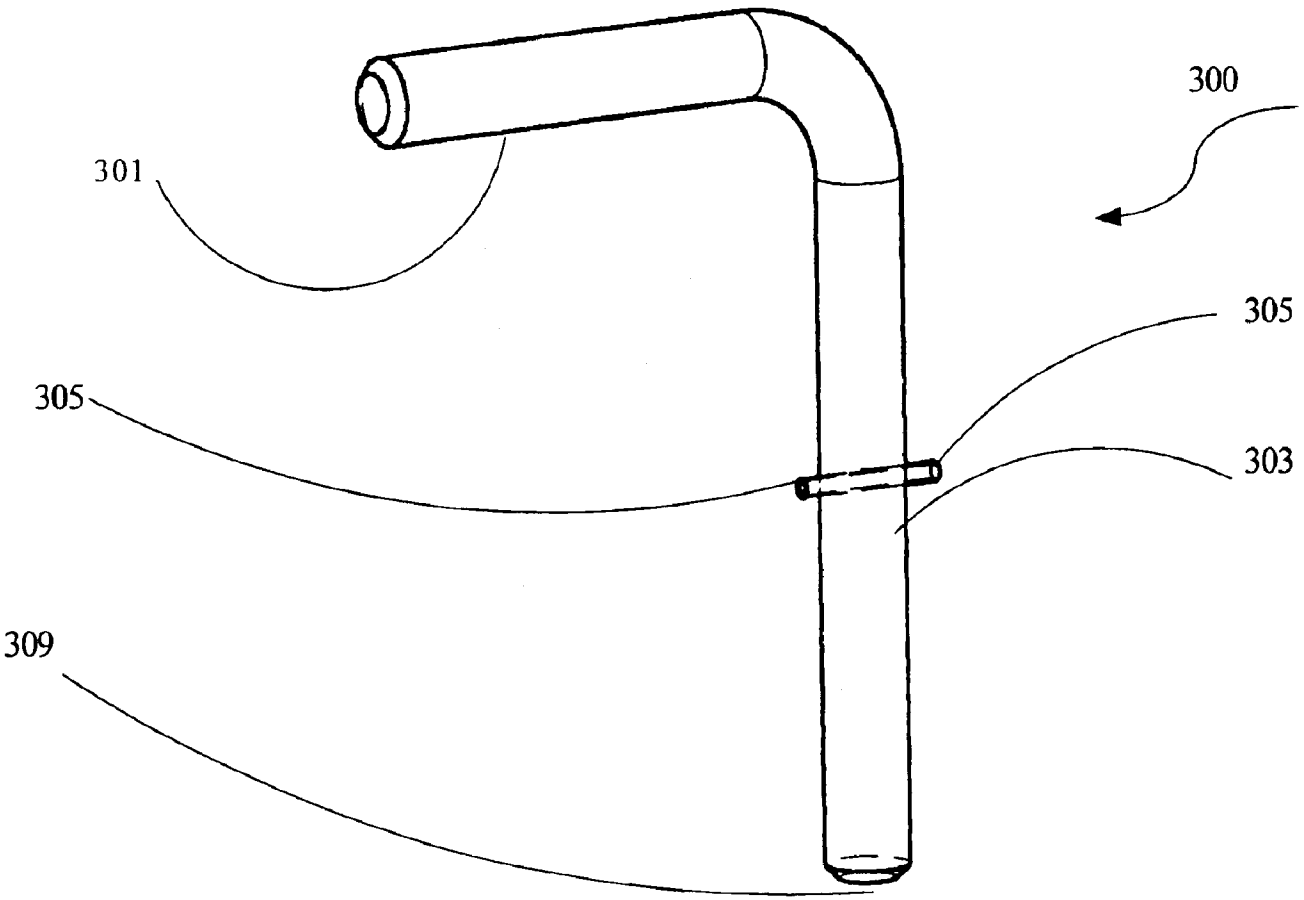
FIG. 12 is a detailed view of one embodiment of the pin.

Referring now to FIG. 12, there is shown detail of a preferred embodiment of pin member (300). Pin member (300) comprises a handle portion (301), a shaft portion (303), an engagement end (309) and two opposite lugs (305) in the shaft of the pin member.

Figure 13:
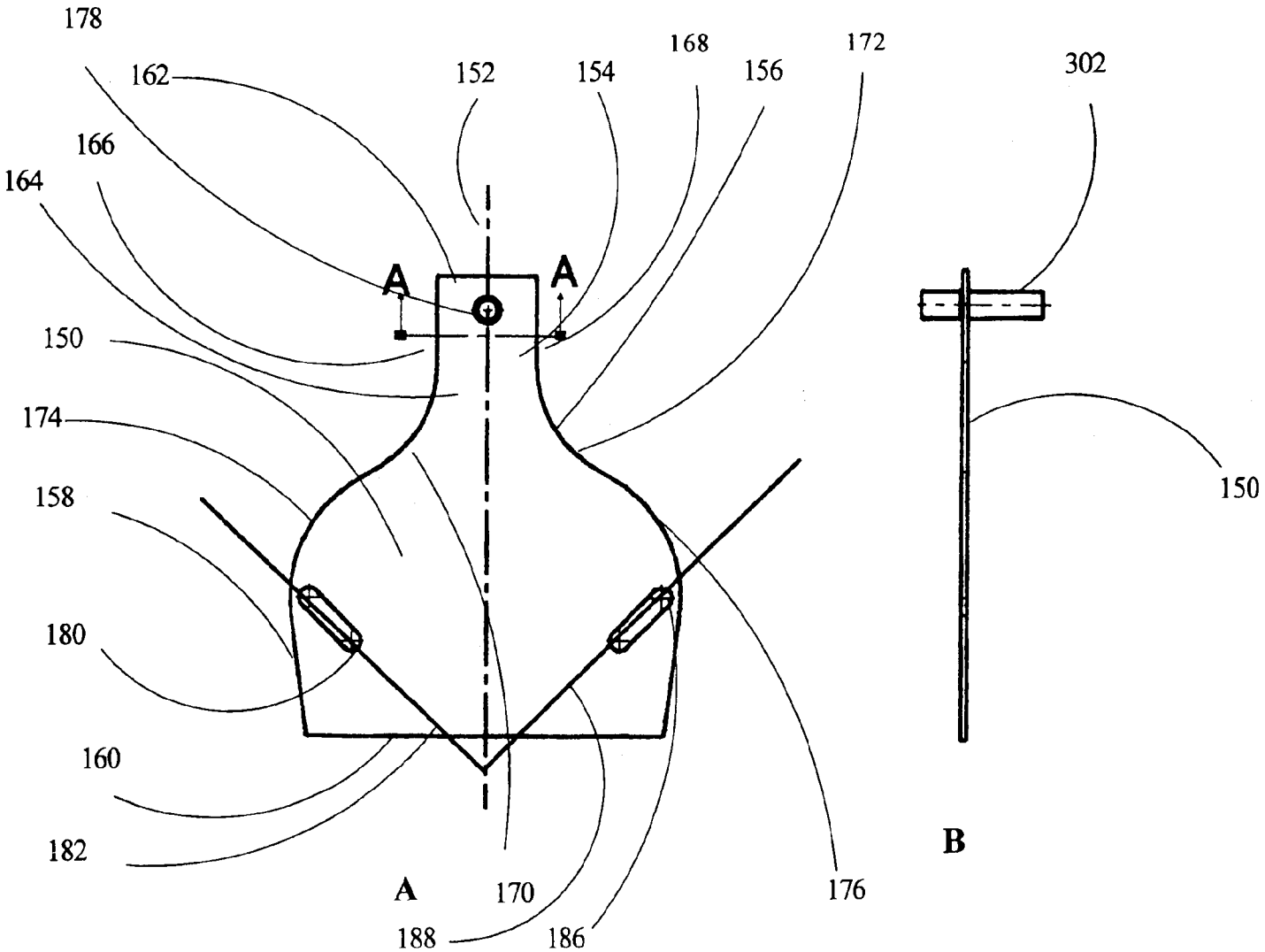
FIG. 13 is an illustration showing a top view (A) and a side view (B) of the first control member of one embodiment of my invention.

Referring now to FIG. 13, there is shown a top view (A) and a side view (B) of first control member (150). The first control member (150) comprises a first flat plate having a longitudinal axis (152). The first flat plate (150) has a paddle shape including four contiguous and congruent portions comprising a shaft portion (154), a throat portion (156), a blade portion (158) and tip portion (160). The shaft portion (154) has a first end (162) having a first width (164), a first side (166) and a second side (168). The first side (166) and said second side (168) are parallel and the first end (162) is disposed perpendicular between the first side (166) and the second side (168). The throat portion (156) has a third side (170) and a fourth side (172). The third and fourth sides have a concave shape to them with a radius of about 2.2 inches. The blade portion (158) has a fifth side (174) and a sixth side (176). The convex portions of the fifth and sixth sides have a radius of about 2.5 inches. The tip portion (160) is linear and disposed between the fifth side and the sixth side, perpendicular to the longitudinal axis (152) and parallel to said first end (162). The tip portion (160) is about 6.75 inches wide and the opposite first end (162) is about 1.87 inches wide. The first control member has a length of about 8.5 inches. The first control member is manufactured from aluminum or stainless steel having a suitable gauge or other suitable material.

Still referring to FIG. 13, the first control member (150) has an aperture (178) located adjacent to the first end (162) and upon the longitudinal axis (152). The aperture (178) is about 0.50 inches in diameter and adapted to receive the guide sleeve (302). Referring back to FIG. 11, the guide sleeve (302) is slotted (307) to receive the lugs 305 located on the pin member (300). The guide sleeve extends about 1.38 inches above the first control member (150) and about 0.50 inches below the control member (150). The blade portion (158) includes a first elongate aperture (180) having a first aperture longitudinal axis (182). The first elongate aperture (180) is located close to the fifth side (174) of the blade portion (158). There is a second elongate aperture (186) having a second aperture longitudinal axis (188). The longitudinal axis (182) and the longitudinal axis (188) are at right angles to each other or about 45 degrees from the vertical. The second elongate temperture (186) is located close to the sixth side (176) of the blade portion (158). While the first control member described herein constitutes the preferred embodiment of this member, it can take other shapes. The first and second elongate apertures are adapted to permit axial alignment of the first and second control members along their respective longitudinal axis.

Referring back to FIG. 9, the first control member (150) is mounted underneath the swivel seat (44) adjacent to bottom surface (81). Elongate apertures (180) and (186) are mounted to the bottom surface (81) of swivel seat (44) so that the second end (153) projects beyond the swivel seat (44) permitting the operator to access the pin (300). The first rectangular upper mounting surface (108) of the second swivel body (92) is mounted below the first control member (150). Shims (107) having a thickness equal to the thickness of the first control member are inserted opposite the first control member (150) so that the control member is maintained parallel to the surface (81). The elongate apertures (180) and (186) are adapted to permit axial adjustment of the first control member (150) with respect to the second control member (200) during installation.

Figure 14:
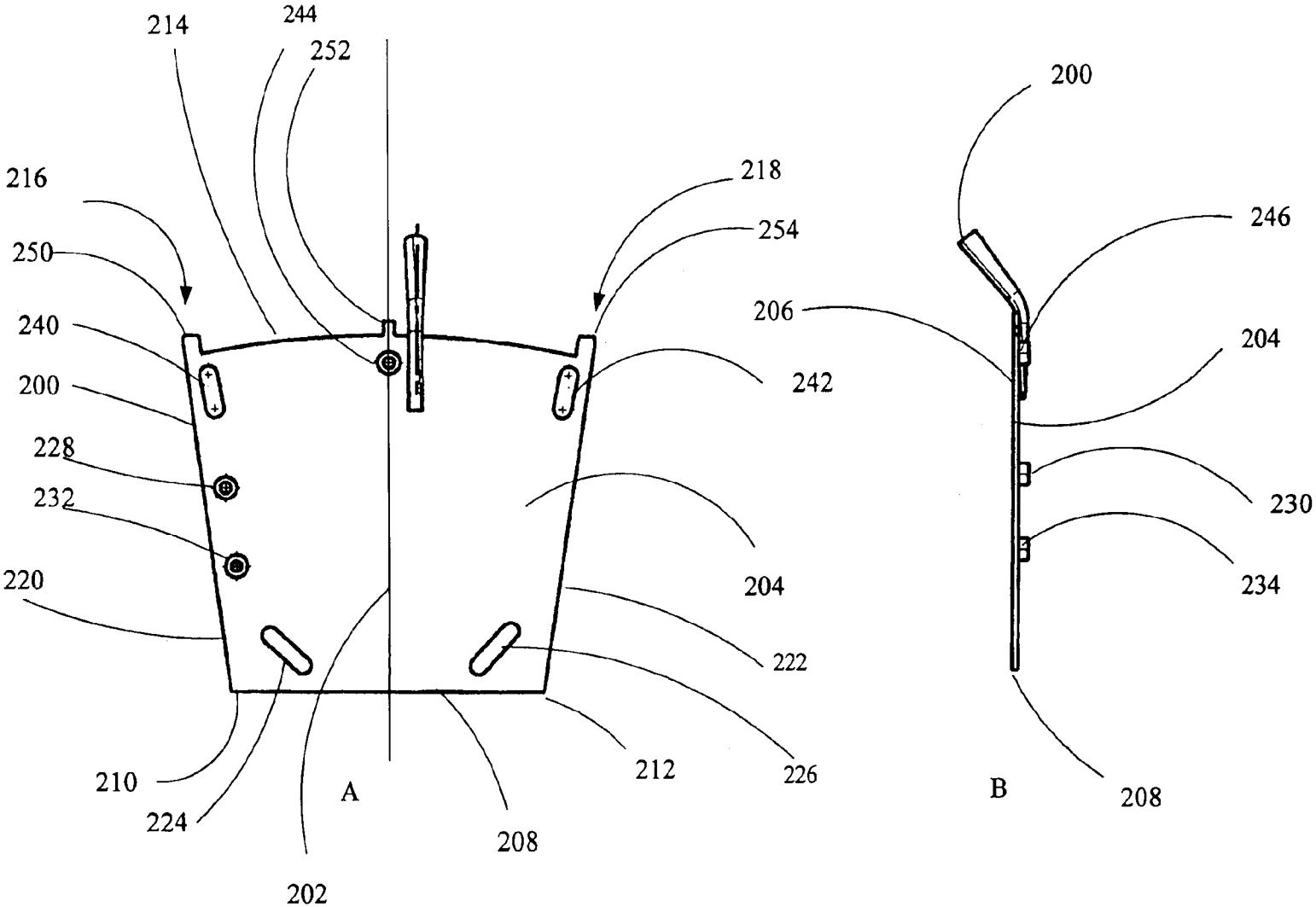
FIG. 14 is a top view (A) and a side view (B) of the second control member of one embodiment of my invention.

Referring now to FIG. 14, there is shown a top view (A) and a side view (B) of the second control member (200). The second control member (200) comprises a second flat plate having a second flat plate longitudinal axis (202), a top surface (204) and a bottom surface (206). The second control member has a substantially keystone shape including a flat bottom side (208), a lower left corner (210), a lower right corner (212), an arcuate top side (214), a top left corner (216), a top right corner (218), a left side (220) inclined away from the second flat plate horizontal axis (202) and a right side (222) inclined away from the second flat plate horizontal axis (202). The second control member (200) further includes a first elongate aperture (224) located proximate to the lower left corner (210). There is also a second elongate aperture (226) located proximate to said lower right corner (212). There is a third aperture (228) located proximate to said left side. The third aperture has a raised collar (230). A fourth aperture (232) is located adjacent to the third aperture (228) and proximate to the left side (220). The fourth aperture has a raised collar (234). There is also a fifth elongate aperture (240) located proximate to the top left corner (216) and a sixth elongate aperture (242) located proximate to said top right corner (218). A seventh aperture (244) is located at the top end of the longitudinal axis (202) and has a raised collar (246). The second control member (200) is manufactured from aluminum or stainless steel having a suitable gauge or other suitable material. The width of bottom side (208) is about 7 inches and the width across the top side (214) is about 9.2 inches. The second control member (200) has a length of about 8 inches. Each of the two bottom elongate apertures (224) and (226) are inclined at an angle of about 45 degrees away from the longitudinal axis (202).

Still referring to FIG. 14, the second control plate (200) further includes a first rectangular projection (250) projecting from the top left corner (216) of the control plate (200), a second rectangular projection (252) projecting from the middle of the arcuate top surface (214) along the control plate longitudinal axis (202) and a third rectangular projection (254) projecting from the top right corner (218) of the control plate (200). The first, second and third rectangular projections are adapted as sighting guides so that an operator can visually guide the third control member (300) into engagement with the second control member (200).

Referring back to FIG. 9, the second control member (200) is mounted by mounting means through apertures (224) and (226) between the bottom member (104) of the second swivel body (92) and the top member (98) of the first swivel body (90). The top curved end (214) of the second control member (200) projects out from under the swivel seat (44) so that the engagement end (309) of pin member (300) is able to engage one of the three the pin engagement apertures of the second control member (200). The pin engagement apertures on the second control member comprise apertures (244), (240) and (242).

Figure 15:
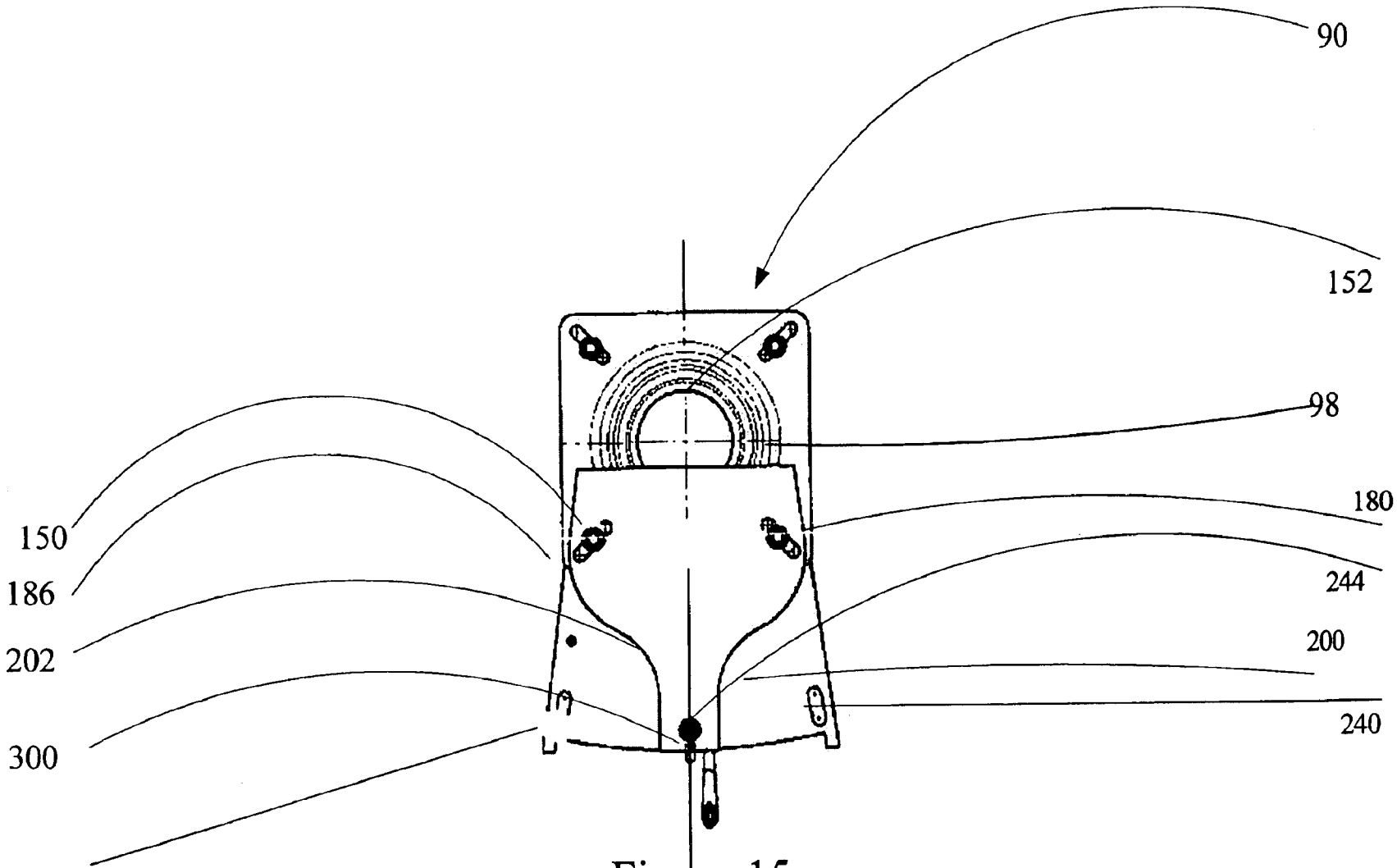
FIG. 15 is a top view showing the operating relationship between the first and second control members.

Referring now to FIG. 15, there is shown the operating relationship between the first control member (150), the second control member (200) and the pin member (300). The view in FIG. 15 is with the swivel seat (44) removed and looking down onto the top mounting member (98) of the second swivel body (92). Note that the elongate apertures (180) and (186) in the first control member (150) and the elongate apertures (224) and (226) (not shown) permit axial adjustment of the first control member (150) with respect to the second control member (200) so that the longitudinal axis (152) of the first control member (150) is aligned with the longitudinal axis (202) of the second control member (200) during initial installation. The initial orientation of control member (150) and control member (200) is shown in FIG. 15 with respect to the bow (16) and stern (18) of the craft. The two control members project to the left (20). In the configuration shown in FIG. 15, the swivel seat is oriented so that the operator sitting in the swivel seat is facing towards the bow (16). The pin member (300) is engaged in a first engagement location with aperture (244) on the second control member (200) thereby fixing the swivel seat (44) in a bow facing orientation. Referring back to FIG. 9, with pin member (300) engaged within aperture (244) swivel body (92) cannot swivel and swivel body (90) can swivel so that swivel seat (44) can swivel with respect to the cross-member (34). Referring again to FIG. 15, the operator may wish to fix the swivel seat in an orientation that permits the operator to face towards the right side (22) of the craft. To do this, the pin member (300) is lifted and disengaged from aperture (244) and the seat is swiveled to a position that is about 30 degrees to right. The pin member is engaged in a second engagement location into aperture (240). Similarly, if the operator wishes to swivel the swivel seat 30 degrees to left the pin member (300) can be engaged in a third engagement location into aperture (242).

Figure 16:
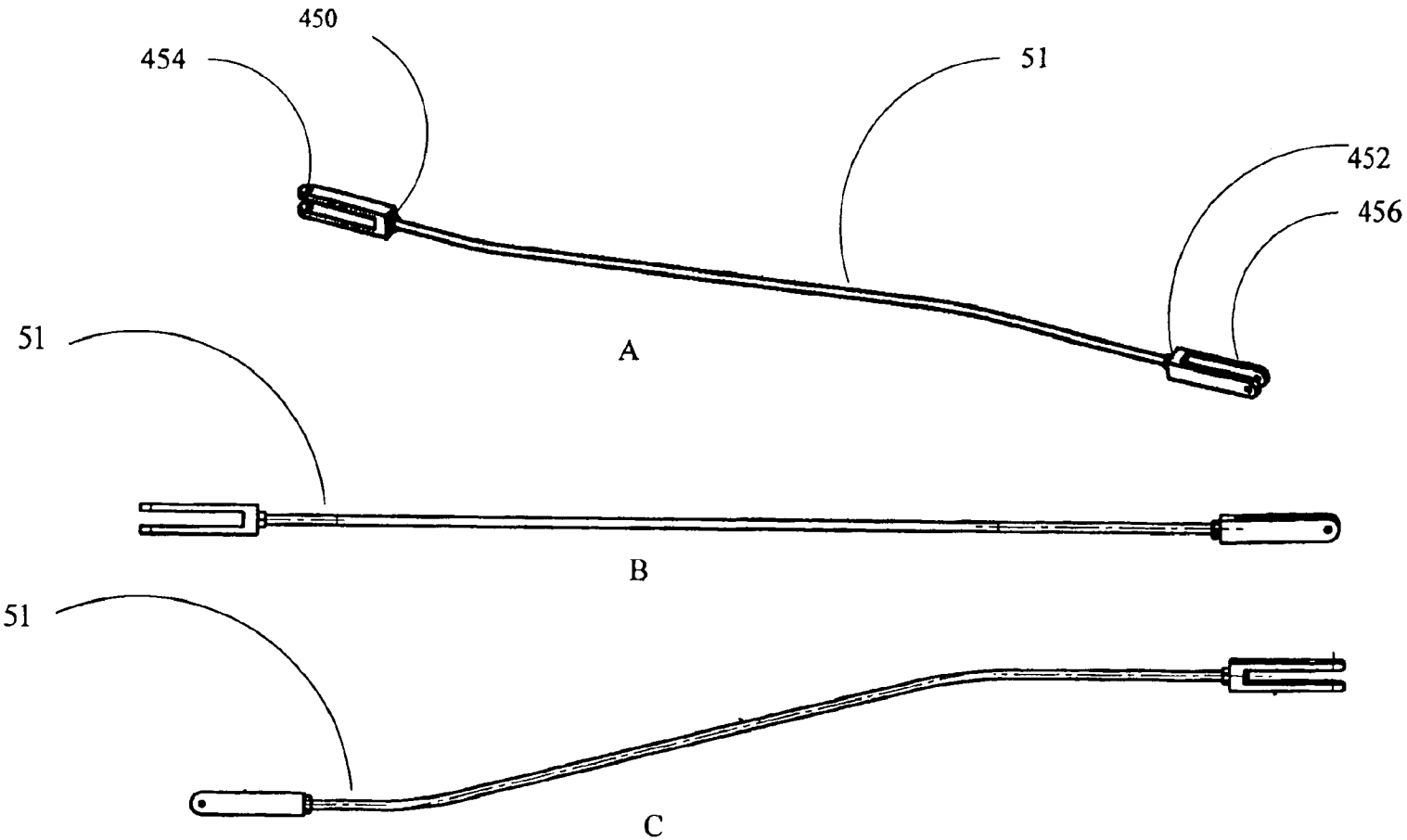
FIG. 16 illustrates three views: A perspective view, B side view, and C top view of the connecting member of one embodiment of my invention.

Referring now to FIGS. 1 to 4 and to FIG. 16, 1 will now describe the means for transmitting body motion commands from the swivel seat (44) to the outboard motor (26). In FIG. 16, there are shown three views (A, B and C) of connecting member (51) having a first threaded end (450) and a second threaded end (452). There is also a first bracket (454) for connecting the connecting member (51) first threaded end (450) to the second control plate (200) and a second bracket (456) (identical to the first bracket illustrated in FIG. 17) for connecting the connecting member (51) second threaded (452) end to the outboard motor (26).

Figure 17:
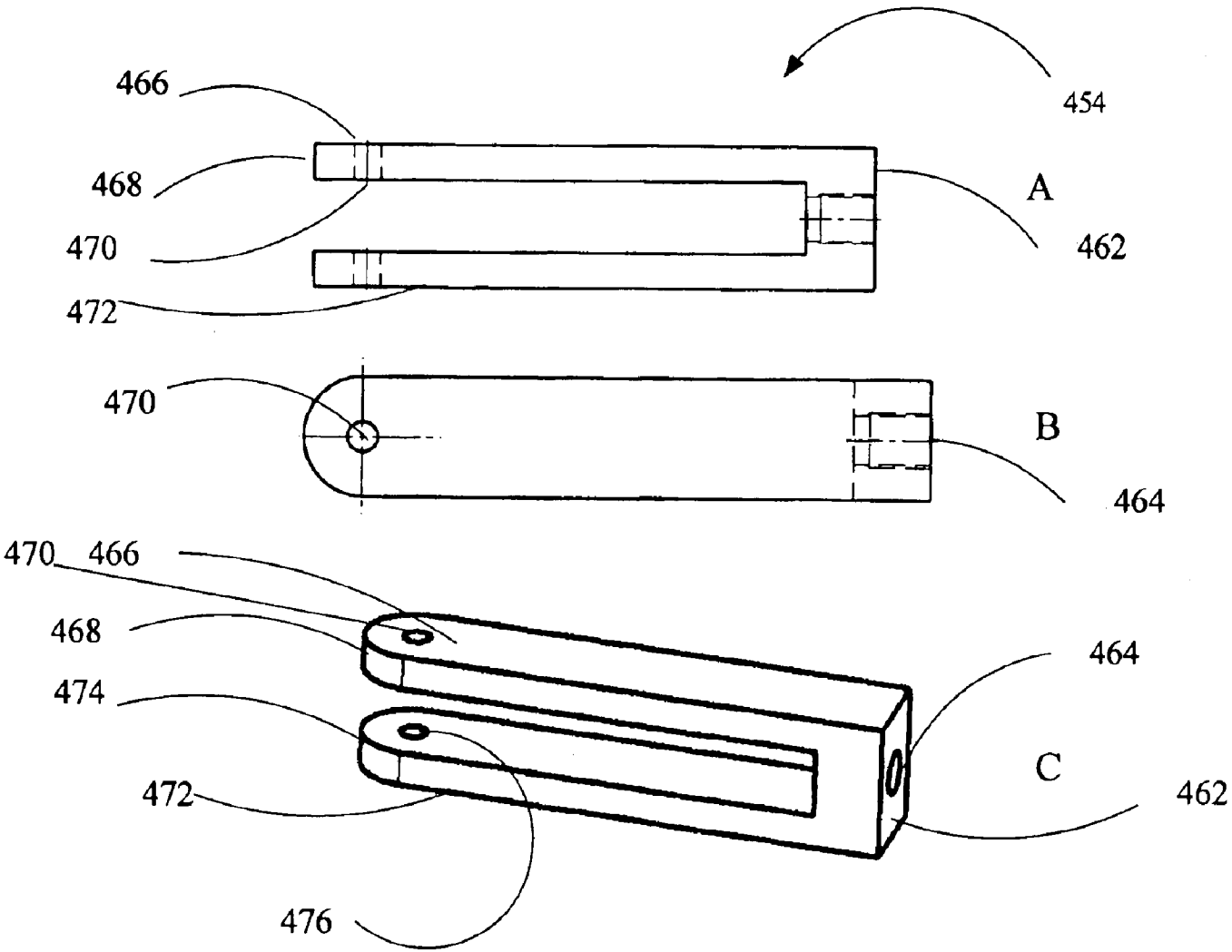
FIG. 17 illustrates three views: A side view, B top view and C perspective view of the bracket of one embodiment of my invention.

Referring now to FIG. 17, there are shown multiple views (side, A; top B; and perspective C) of one embodiment of the bracket (454). Bracket (454) comprises a base (462) having a threaded aperture (464) adapted to receive the connecting member threaded ends (450) and (452). There is also a first tine (466) fixed to the base (462). The first tine has a first arcuate free end (468) and a first tine first aperture (470). There is also a second tine (472) fixed to the base (462) opposite to and parallel to the first tine (466). The second tine has a second arcuate free end (474) and a second tine second aperture (476).

Figure 18:
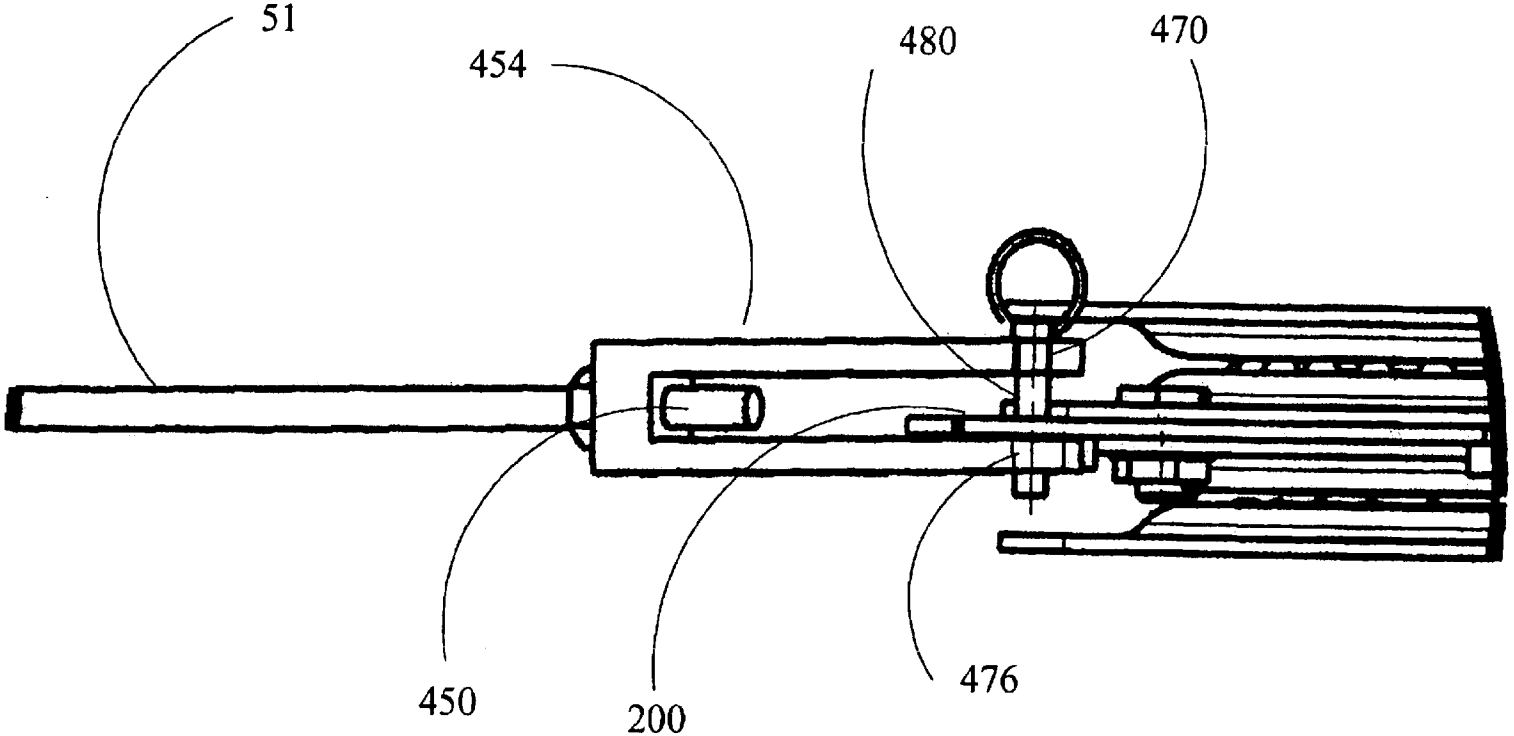
FIG. 18 is a detailed view of the connection of a bracket to the second control member of one embodiment of my invention.

Referring to FIG. 18, there is illustrated first means for connecting the connecting member first threaded end to the second control member. Bracket (454) is adapted to receive the left side of the control plate (200) between the first and second tines. The first tine first aperture (470) and the second tine second aperture (476) are co-axially aligned with the control plate third aperture (228) or alternatively control plate fourth aperture (232). A pin member (480) adapted for quick releasable placement within the co-axially aligned first tine first aperture, second tine second aperture and control plate third aperture is inserted thereby fixing the connecting member (51) to the second control plate.

Figure 19:
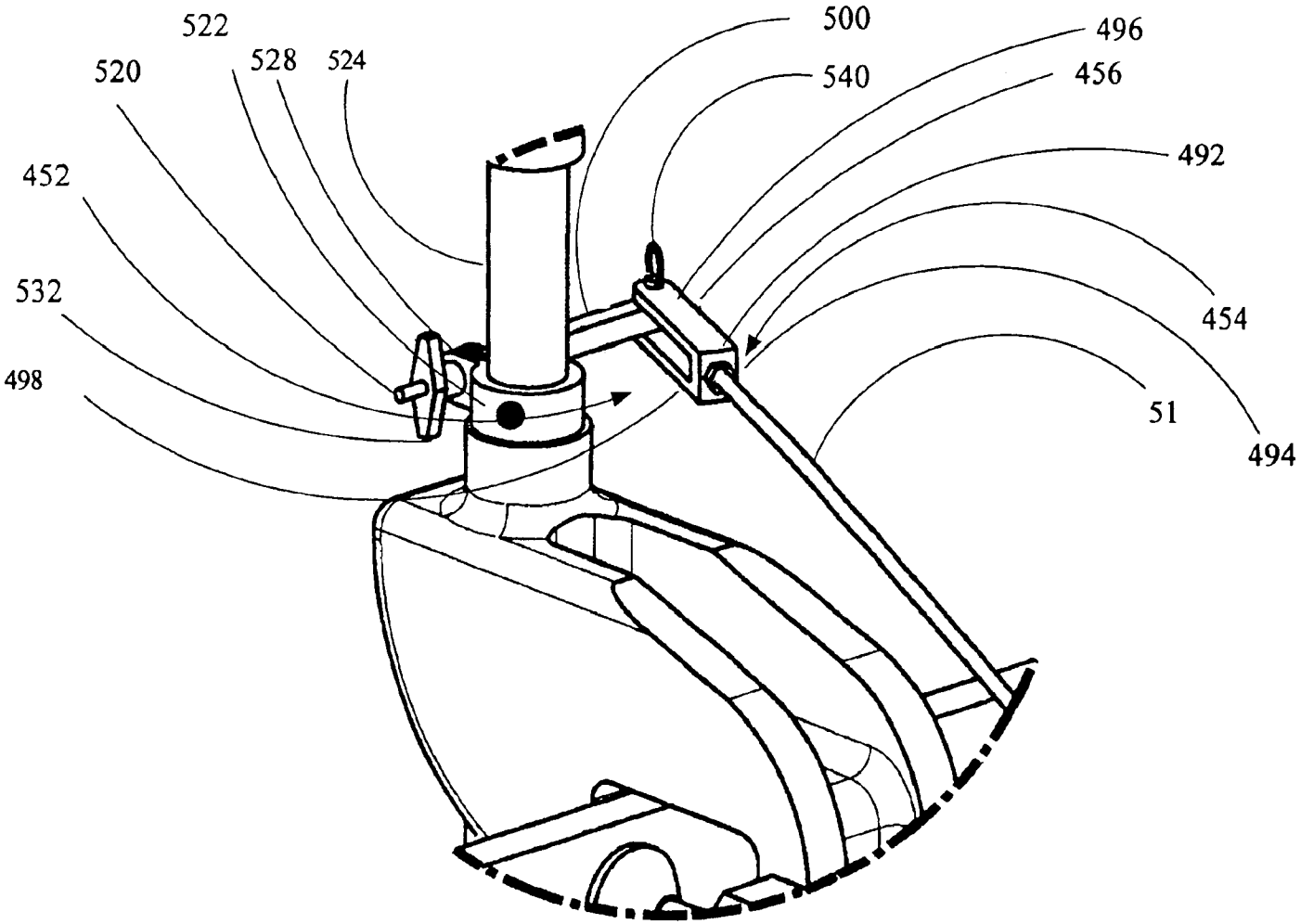
FIG. 19 is a detailed view of the connection of a bracket to the connecting arm of one embodiment of my invention.

Referring to FIG. 19, there is illustrated second means for connecting the connecting member threaded second end to the outboard motor (26). There is a second bracket (456) comprising a second base (492) having a second threaded aperture (494) adapted to receive connecting member threaded end. There is a third tine (496) fixed to the second base with an arcuate free end and an aperture. There is a fourth tine (498) fixed to the second base opposite to and parallel to the third tine. The fourth tine has a fourth arcuate free end with a fourth tine fourth aperture.

Since both ends of the connecting member (51) are threaded into a bracket the tension in the connecting member can be adjusted by threading more or less of the threaded ends of the connecting member into the bracket. As well, the connecting member has a contoured shape to permit transmission of movements from the swivel seat (44) to the outboard motor (26) in an offset manner.

Figure 20:
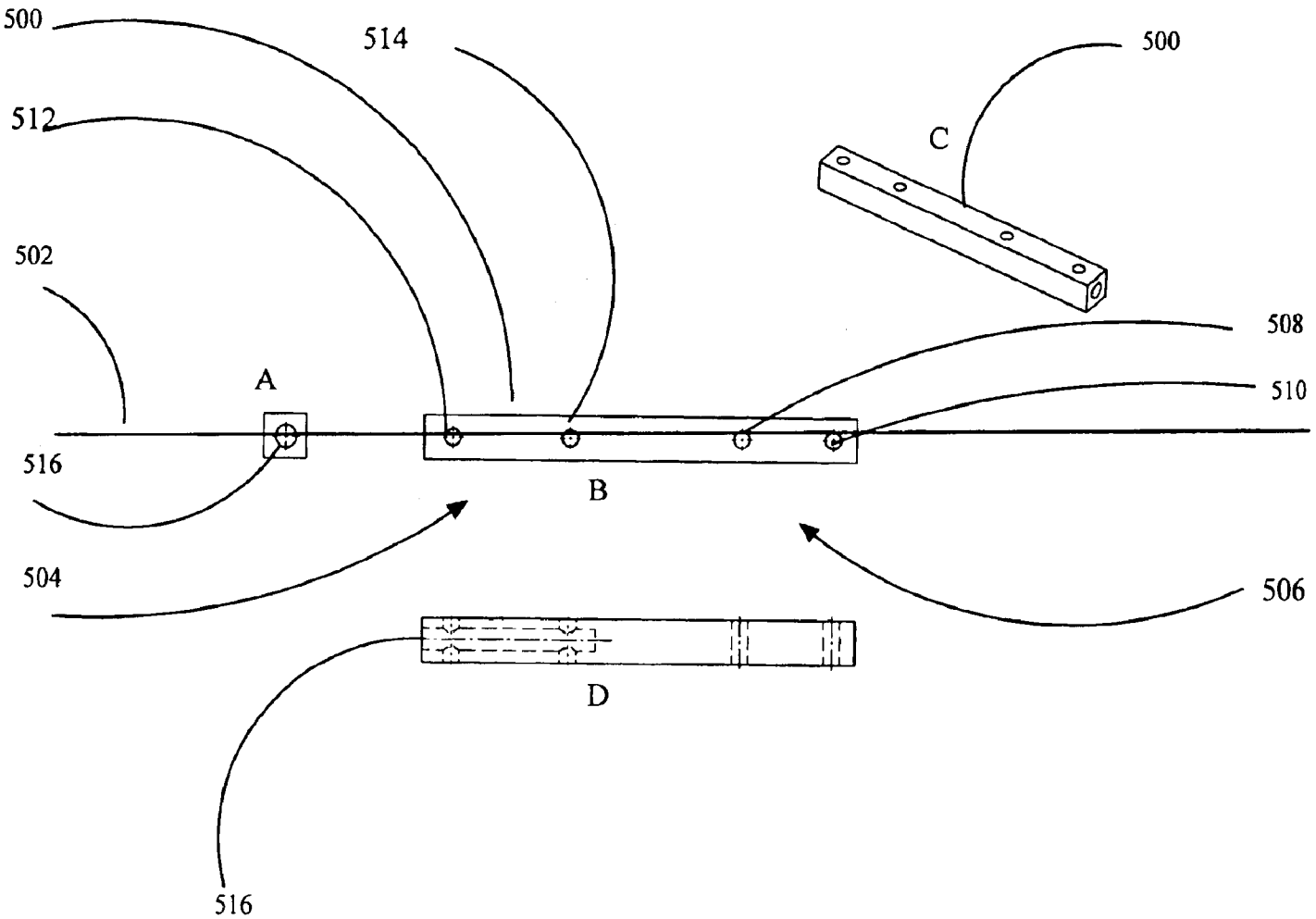
FIG. 20 is an illustration of various views: A frontal view, B top view, C perspective view and D side view of the connecting arm of one embodiment of my invention.

Referring to FIG. 19 and FIG. 20, there is shown a bracket arm (500) having a longitudinal axis (502), a first half (504) and a second half (506). The first half has at least two apertures (512) and (514) positioned vertically. The second half has at least two apertures (508) and (510) positioned vertically. There is also one threaded longitudinal bore (516) adapted to receive threaded rod (520). Friction clamp (522) is adapted to clamp around the vertical shaft casing (524) of the outboard motor (26). The friction clamp (522) has a collar portion (526) adapted to frictionally engage the vertical shaft casing and two adjacent and parallel arms (528) and (530 not shown) apertured to receive threaded rod (520). There is a nut (532) adapted for threaded engagement onto the threaded rod so that the two adjacent and parallel arms are between the nut and the bracket second end. When the nut is rotated towards the bracket second end the two adjacent and parallel arms are compressed together thereby tightening the collar about the vertical shaft casing. A quick release pin (540) is provided for pinning the bracket first end between the third tine and the fourth tine in a pivoting engagement.

Referring back to FIG. 9, when the swivel motion of the swivel seat (44) is fixed with respect to the swivel motion of the control plate (200), arm (600) is used to control the direction of the swivel seat and as well the movement of the outboard motor. Arm (600) comprises shaft (602) having a first end (604) and a second end (606). Attached to the second end (606) is hand control knob (608) used by the operator to push the shaft bow ward or stem ward. The first end (604) is placed into shaft receiver (610) welded to the bottom surface of control member (200).

Figure 21:
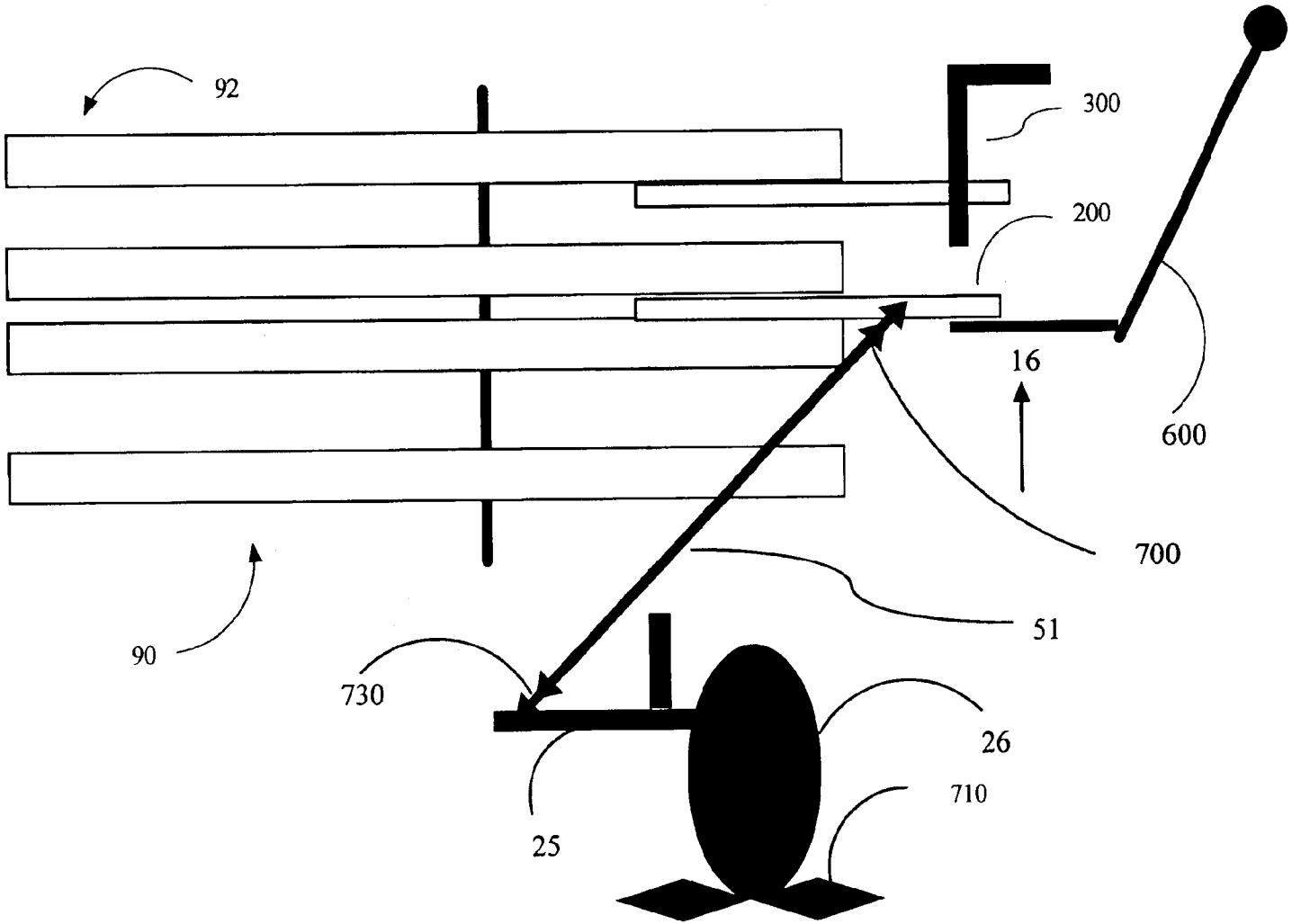
FIG. 21 is a view of the operation of one embodiment of my invention with the pin member disengaged.

Referring now to FIG. 21, there is shown a diagram of the operation of my invention with the pin member (300) disengaged from control member (200). When the pin member (300) is disengaged from control member (200) first swivel body (90) and second swivel body (92) are free to swivel with respect to each other. Therefore, swivel seat (44) is free to swivel in any direction and cannot be used to direct the boat. The body motion steering control apparatus is disengaged. The arm (600) can be used to direct the craft in a desired direction or alternatively, the operator can swivel the swivel seat-towards the stem and control the direction of the boat using the arm (25) of the outboard motor (26). If the operator wishes the boat to go to the left the arm (600) is moved towards the bow (16) of the boat. This motion is transmitted by connecting member (51) in a pulling motion as indicated by arrows (700) side and the outboard motor (26) is turned so that the propeller (710) swings to the left pushing the bow of the boat to the left. If the operator wishes the boat to go to the right the arm (600) is moved towards the stern (18). The motion is transmitted by connecting member (51) as a pushing motion as indicated by arrows (730) and the propeller is forced to the right. The bow is then driven to the right.

Figure 22:
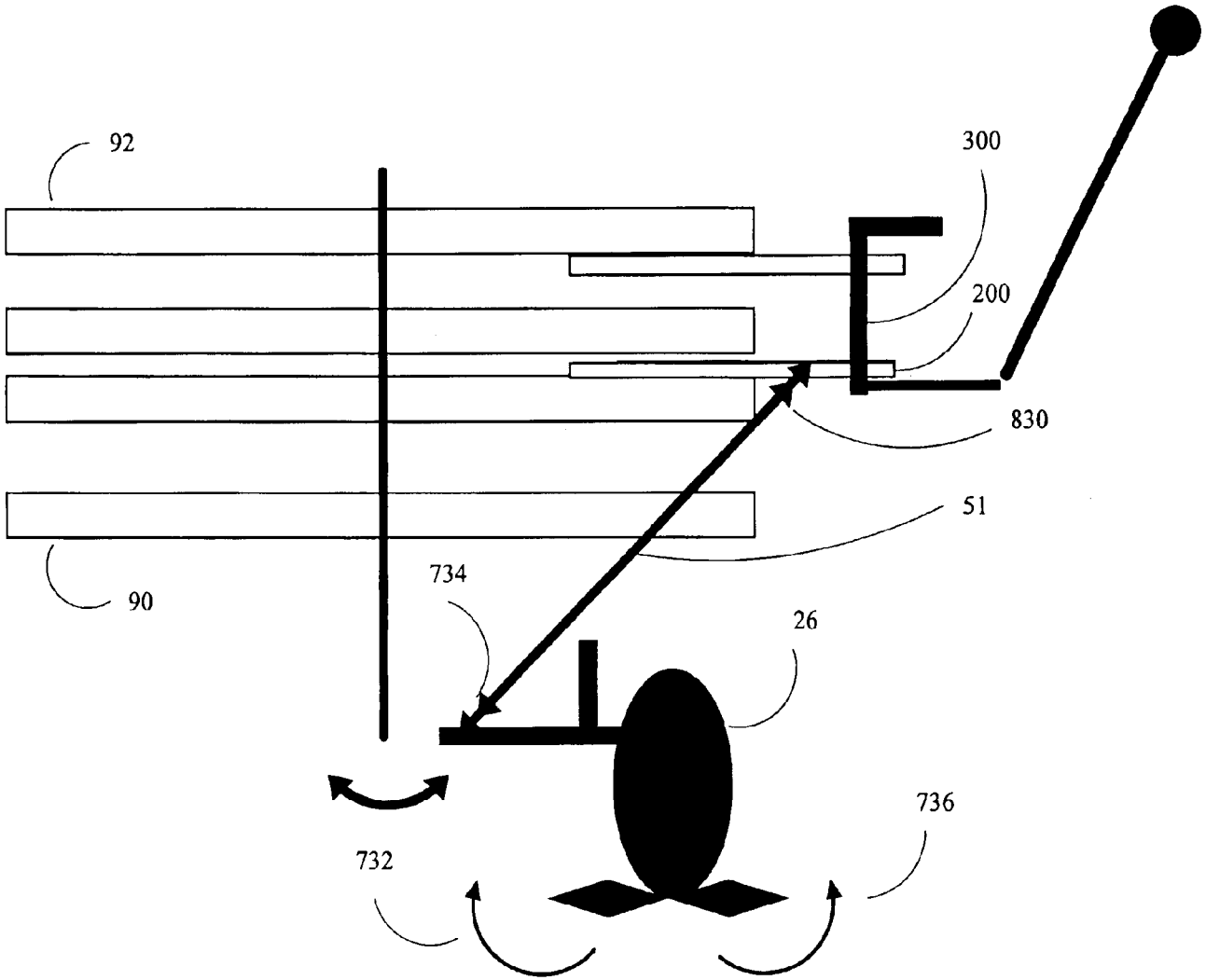
FIG. 22 is a view of the operation of one embodiment of my invention with the pin member engaged.

Referring now to FIG. 22, the control pin (300) is engaged with control member (200). When the control pin is engaged the body motion steering control apparatus is engaged. First swivel body (90) is fixed and second swivel body (92) is permitted rotational movement. Therefore, only the swivel seat (44) may swivel with respect to mounting member (34). The swivel seat (44) can be used by the operator to impart motion to the propeller in order to direct the boat. In FIG. 22, if the operator swivels the seat to the right the swivel motion is transmitted by connecting member (51) to the motor as a pushing motion as indicated by arrows (734). This pushing motion causes the propeller on the motor (26) to turn to the right as shown by arrow (736) pushing the bow of the boat to the right. If the operator wishes the boat to move to the left, the operator swivels the swivel seat to the left this causes a pulling motion in connecting member (51) as indicated by arrows (830) causing propeller to move to the left as indicated by arrow (732). This pushes the bow to the left.

By using the swivel seat, the operator is able to troll at low speeds while fishing and use body motion to swivel the seat to the left or the right in order to direct the boat. This is a preferred hands free operation allowing the operator to concentrate on the sport. As previously noted, the operator can lock the swivel seat 30 degrees to the left or the right permitting the operator to face the desired side of the boat while using body motion to steer the boat.

Other embodiments of my invention are contemplated. For example, the arm (600) and shaft receiver (610) shown on FIG. 9 may be a single piece of solid, half inch round aluminum rod, welded to the control member (200).

In another embodiment of the invention, the first control member (150) can have the same dimensions as the second control member.

In still another embodiment of my invention, an optional bracket can be attached to the swivel seat (44) having control means to control the operation of the motor, such as start-stop and throttle.

Although this description has much specificity, these should not be construed as limiting the scope of the invention but as merely providing illustrations of some of the presently preferred embodiments of this invention. Thus the scope of the invention should be determined by the appended claims and their legal equivalents, rather than by the examples given.

What is Claimed is:

1. An apparatus for steering control of a water craft by operator body motion commands, said water craft having at least one flat hull cross-member having an upper surface, wherein the water craft is propelled by an outboard motor having a first vertical axis, said apparatus comprising:

a. a swivel seat for accepting said body steering commands, said swivel seat comprising swivel means for rotation about a second vertical axis and a bottom surface, wherein the swivel seat has:

i. a first disengaged mode wherein the body motion commands are not transmitted to said outboard motor; and, ii. a second engaged mode wherein the body motion commands are transmitted to the outboard motor;

b. means for moving the swivel seat from said first disengaged mode to said second engaged mode and back again to the first disengaged mode; and, c. means for transmitting the body motion commands to the outboard motor, whereby the body motion commands are translated into steering commands causing the outboard motor to pivot in a desired direction about the first vertical axis.

2. The apparatus as claimed in claim 1, wherein said swivel means comprises:

a. a first swivel co-axial with the second vertical axis and mounted by mounting means to said at least one flat hull cross-member upper surface; and, b. a second swivel co-axial with said second vertical axis and mounted by mounting means between said first swivel and said bottom surface of said swivel seat.

3. The apparatus as claimed in claim 2, wherein said engagement means comprises:

a. a first control member having a first end and a second end, wherein said first control member first end is mounted by mounting means between the first swivel and the swivel seat bottom surface, and wherein a slotted sleeve is fixed to said first control member second end;

b. a second control member having a first end and a second end, wherein said second control member first end is mounted by mounting means between the first swivel and the second swivel, and wherein said second control member second end has an aperture and said aperture co-axial with said slotted sleeve;

c. a retractable biased engagement pin slidably mounted within the slotted sleeve, said pin having an engagement end and:

d. a first retracted position wherein said engagement end is disengaged from the aperture resulting in the swivel scat being in its first disengaged mode; and, e. a second engaged position wherein the engagement end is engaged with the aperture thereby coupling the first control member to the second control member resulting in the swivel seat being in its second engaged position so that the first and second control members rotate dependently, the result being that rotation of the swivel seat about the second vertical axis causes identical rotation of the second control member about the second vertical axis.

4. The apparatus as claimed in claim 3, wherein means for transmitting the body motion commands to the outboard motor comprises a connecting member having a first end and a second end, wherein said first end is connected by first connecting means to the second control member, and wherein said second end is connected by second connecting means to the outboard motor, so that movement of the second control member about the second vertical axis is transmitted by said connecting member to the outboard motor and translated into sympathetic movement of the outboard motor about said first vertical axis.

5. The apparatus as claimed in claim 4, wherein the first swivel comprises:

a. a first upper mounting plate mounted by mounting means to said bottom surface of said seat body;

b. a first lower mounting plate; and, c. a first circular bearing track disposed between said first lower mounting plate and said first upper mounting plate, said first circular bearing track including a first plurality of bearings disposed in the first circular bearing track, said first plurality of bearings permitting rotation of the first lower mounting plate with respect to the first upper mounting plate; and wherein the second swivel comprises:

d. a second upper mounting plate mounted by mounting means to said first lower mounting plate;

e. a second lower mounting plate mounted by mounting means to said upper surface of said at least one hull cross-member; and, f. a second circular bearing track disposed between said second lower mounting plate and said second upper mounting plate, said second circular bearing track including a second plurality of bearings disposed in the second circular bearing track, said second plurality of bearings permitting rotation of the second lower mounting plate with respect to the second upper mounting plate.

6. The apparatus as claimed in claim 5, wherein the swivel seat comprises:

a. a horizontal seating platform having a left side and a right side, said horizontal seating platform contoured for receiving the buttocks of an operator;

b. an upward sloping left side member fixed to said left side of the horizontal seating platform, wherein said left side member is adjacent to the left thigh of an operator and contoured to receive the contour of the left thigh of an operator;

c. an upward sloping right side member fixed to said right side of the horizontal seating platform, said right side member positioned adjacent to the right thigh of an operator and contoured to receive the contour of the right thigh of an operator, and;

d. a backrest fixed to the horizontal seating platform, said backrest adapted for pivoting adjustment about a first horizontal axis for operator comfort.

7. The apparatus as claimed in claim 6, wherein the first control member comprises a first plate having a longitudinal axis, said first plate having a paddle shape, said paddle shape comprising four contiguous and congruent portions comprising a shaft portion, a throat portion, a blade portion and tip portion, wherein:

a. said shaft portion has a first end having a first width, a first side and a second, wherein said first side and said second side are parallel and wherein said first end is disposed perpendicular between the first side and the second side;

b. said throat portion has a third side and a fourth side, wherein said third side and said fourth side are incurvate;

c. said blade portion has a fifth side and a sixth side, wherein said fifth side and said sixth side are arcuate, and, d. said tip portion is linear and disposed between the fifth side and the sixth side, perpendicular to the longitudinal axis and parallel to said first end.

8. The apparatus as claimed in claim 7, wherein the shaft portion includes an aperture located adjacent to the first end and upon the longitudinal axis.

9. The apparatus as claimed in claim 8, wherein the blade portion includes:

a. a first elongate aperture having a first aperture longitudinal axis, wherein said first aperture longitudinal axis has a first acclivity of about negative 45 degrees from the first control member longitudinal axis, and further wherein said first elongate aperture is located close to the fifth side; and, b. a second elongate aperture having a second aperture longitudinal axis, wherein said second aperture longitudinal axis has a second acclivity of about positive 45 degrees from the first control member longitudinal axis, and further wherein said second elongate aperture is located close to the sixth side.

10. The apparatus as claimed in claim 9, wherein the blade portion is mounted between the bottom surface of the seat body and the second rectangular upper mounting plate.

11. The apparatus as claimed in claim 10, wherein said second control member comprises a second flat plate having a second flat plate longitudinal axis, a top surface and a bottom surface, wherein said second flat plate has a substantially keystone shape including a flat bottom side, a lower left corner, a lower right corner, an arcuate top side, a top left corner, a top right corner, a left side inclined away from said second flat plate horizontal axis, and a right side inclined away from the second flat plate horizontal axis.

12. The apparatus as claimed in claim 11, wherein said second control member further includes:

a. a first elongate aperture located proximate to said lower left corner;

b. a second elongate aperture located proximate to said lower right corner;

c. a third aperture located proximate to said left side, said third aperture including a raised collar;

d. a fourth aperture located adjacent to said third aperture and proximate to said left side, said fourth aperture including a raised collar;

e. a fifth elongate aperture located proximate to said top left corner;

f. a sixth elongate aperture located proximate to said top right corner; and, g. a seventh aperture located at the top end of the longitudinal axis of the second control member.

13. The apparatus as claimed in claim 12, wherein the second control member further includes:

a. a first rectangular projection projecting from said top left corner;

b. a second rectangular projection projecting from the middle of said arcuate top surface along the said longitudinal axis; and, c. a third rectangular projection projecting from said top right corner, wherein said first, second and third rectangular projections are adapted as sighting guides so that an operator can visually guide the third control member into engagement with the second control member.

14. The apparatus as claimed in claim 13, wherein the second control member is mounted by mounting means between the first rectangular upper mounting plate and the second rectangular lower mounting member.

15. The apparatus as claimed in claim 14, wherein said means for transmitting said body use motion commands from the seat body to said outboard motor comprise:

a. a connecting member having a first threaded end and a second threaded end;

b. first means for connecting said connecting member first threaded end to the second control member; and, c. first means for connecting said connecting member second threaded end to the outboard motor.

16. The apparatus as claimed in claim 15, wherein said first means for connecting the connecting member first end to the second control member comprises a bracket comprising:

a. a base having a threaded aperture adapted to receive the connecting member first threaded end;

b. a first tine fixed to said base, said first tine having an first arcuate free end, said first arcuate free end having a first tine first aperture;

c. a second tine fixed to the base opposite to and parallel to said first tine, said second tine having a second arcuate free end, said second arcuate free end having a second tine second aperture wherein the bracket is adapted to receive the left side of the control member between the first and second tines, and wherein said first tine first aperture and said second tine second aperture are co-axially aligned with the control plate third aperture; and, d. a second pin member adapted for releasable engagement within the co-axially aligned first tine first aperture, second tine second aperture and second control member third aperture thereby fixing the connecting member first end to the second control member in a pivoting relationship.

17. The apparatus as claimed in claim 16, wherein the connecting member first end is fixed to the second control plate fourth aperture in a pivoting relationship.

18. The apparatus as claimed in claim 17, wherein said second means for connecting the connecting member second end to the outboard motor comprises a second bracket comprising:

a. a second base having a second threaded aperture adapted to receive the connecting member second threaded end;

b. a third tine fixed to said second base, said third tine having an third arcuate free end, said third arcuate free end having a third tine third aperture;

c. a fourth tine fixed to the second base opposite to and parallel to said third tine, said fourth tine having a fourth arcuate free end, said fourth arcuate free end having a fourth tine fourth aperture;

d. a bracket arm having a longitudinal axis, a first half and a second half, said first half having at least two apertures positioned vertically; said second half having at least two apertures positioned vertically and one threaded longitudinal bore adapted to receive a threaded rod;

e. a friction clamp adapted to clamp around the vertical shaft casing of said outboard motor, said friction clamp having a collar portion adapted to frictionally engage said vertical shaft casing and two adjacent and parallel arms apertured to receive said threaded rod;

f. a throttling nut adapted for threaded engagement onto the threaded rod so that said two adjacent and parallel arms are between said throttling nut and said bracket second end, so that when the throttling nut is rotated towards the bracket second end the adjacent and parallel arms are compressed together thereby tightening the collar about the vertical shaft casing; and, g. a pin for releasably pinning the bracket first end between the third tine and the fourth tine in a pivoting relationship.

* * * * *